US008563325B1

(12) United States Patent
Bartsch et al.

(10) Patent No.: US 8,563,325 B1
(45) Date of Patent: Oct. 22, 2013

(54) COAXIAL MICROREACTOR FOR PARTICLE SYNTHESIS

(75) Inventors: Michael Bartsch, Menlo Park, CA (US); Michael P. Kanouff, Livermore, CA (US); Scott M. Ferko, Livermore, CA (US); Robert W. Crocker, Fremont, CA (US); Karl Wally, Lafayette, CA (US)

(73) Assignee: Sandia Corporation, Albuquerque, NM (US)

( * ) Notice: Subject to any disclaimer, the term of this patent is extended or adjusted under 35 U.S.C. 154(b) by 271 days.

(21) Appl. No.: 12/893,915

(22) Filed: Sep. 29, 2010

Related U.S. Application Data

(60) Provisional application No. 61/246,593, filed on Sep. 29, 2009.

(51) Int. Cl.
*B01L 3/00* (2006.01)

(52) U.S. Cl.
USPC ..... 436/180; 436/174; 422/503; 422/502

(58) Field of Classification Search
USPC ..... 436/174, 180; 422/50, 68.1, 82.05, 502, 422/503; 435/287.1
See application file for complete search history.

(56) References Cited

U.S. PATENT DOCUMENTS

| | | | | |
|---|---|---|---|---|
| 5,932,315 | A * | 8/1999 | Lum et al. | 428/172 |
| 5,985,356 | A | 11/1999 | Schultz | |
| 6,063,633 | A | 5/2000 | Willson | |
| 6,149,882 | A | 11/2000 | Guan | |
| 6,932,951 | B1 | 8/2005 | Losey | |
| 2004/0022690 | A1 | 2/2004 | Kawai | |

FOREIGN PATENT DOCUMENTS

| | | | |
|---|---|---|---|
| DE | 19806848 | A1 | 8/1999 |
| EP | 1106244 | A2 | 6/2001 |
| WO | 98/07026 | A1 | 2/1998 |
| WO | 99/41005 | A1 | 8/1999 |
| WO | 2008/052138 | A2 | 5/2008 |

OTHER PUBLICATIONS

Lee, Gwo-Bin et al. "Micromachined pre-focusedM × N flow switches for continuous multi-sample injection." J Micromech Microeng (2001) 11 654-661.*

Petersson, Filip et al. "Carrier Medium Exchange through Ultrasonic Particle Switching in Microfluidic Channels." Anal Chem (2005) 77 1216-1221.*

(Continued)

*Primary Examiner* — Yelena G Gakh
*Assistant Examiner* — Christopher A Hixson
(74) *Attorney, Agent, or Firm* — Timothy P. Evans

(57) ABSTRACT

A coaxial fluid flow microreactor system disposed on a microfluidic chip utilizing laminar flow for synthesizing particles from solution. Flow geometries produced by the mixing system make use of hydrodynamic focusing to confine a core flow to a small axially-symmetric, centrally positioned and spatially well-defined portion of a flow channel cross-section to provide highly uniform diffusional mixing between a reactant core and sheath flow streams. The microreactor is fabricated in such a way that a substantially planar two-dimensional arrangement of microfluidic channels will produce a three-dimensional core/sheath flow geometry. The microreactor system can comprise one or more coaxial mixing stages that can be arranged singly, in series, in parallel or nested concentrically in parallel.

21 Claims, 14 Drawing Sheets

(56) References Cited

OTHER PUBLICATIONS

S. Desportes; Z. Yatabe; S. Baumlin; V. Genot; J-P. Lefevre; H. Ushiki; J. A. Delaire; R. B. Pansu; "Fluorescence lifetime imaging microscopy for in situ observation of the nanocrystallization of rubrene in a microfluidic set-up", Chemical Physics Letters, 2007, 446, pp. 212-216.

S. A. Pabit; S. J. Hagen;"Laminar-Flow Fluid Mixer for Fast Fluorescence Kinetics Studies", Biophysical Journal, 2002, 83, pp. 2872-2878.

H. Nagasawa; T. Tsujiuchi; T. Maki; K. Mae; "Controlling Fine Particle Formation Processes Using a Concentric Microreactor", American Institute of Chemical Engineers (AIChE) Journal, 2007, 53(1), pp. 196-206.

T. L. Sounart; P. A. Safier; J. A. Voigt; J. Hoyt; D. R. Tallant; C. M. Matzke; T. A. Michalske; "Spatially-resolved analysis of nanoparticle nucleation and growth in a microfluidic reactor", Lab on a Chip, 2007, 7, pp. 908-915.

H. Klank; G. Goranovic; J. P. Kutter; H. Gjelstrup; J. Michelsen; C. H. Westergaard; "PIV measurements in a microfluidic 3D-sheathing structure with three-dimensional flow behaviour", Journal of Micromechanics and Microengineering, 2002, 12, pp. 862-869.

X. Mao; J. R. Waldeisen; T. J. Huang; ""Microfluidic drifting"—Implementing three-dimensional hydrodynamic focusing with a single-layer planar microfluidic device", Lab Chip, 2007, 7, pp. 1260-1262.

S. Hardt, K. S. Drese; V. Hessel; F. Schonfeld; "Passive micromixers for applications in the microreactor and micro-TAS fields", Microfluidics and Nanofluidics, 2005, 1, pp. 108-118.

S. Krishnadasan, J. Tovilla, R. Vilar; A. J. deMello; J. C. deMello; "On-line analysis of CdSe nanoparticle formation in a continuous flow chip-based microreactor", Journal of Material Chemistry, 2004, 14, pp. 2655-2660.

G. Hairer; G. S. Parr; P. Svasek; A. Jachimowicz; M. J. Vellekoop; "Investigations of micrometer sample stream profiles in a three-dimensional hydrodynamic focusing device", Sensors and Actuators B, 2008, 132, pp. 518-524.

R. Scott; P. Sethu; C. K. Harnett; "Three-dimensional hydrodynamic focusing in a microfluidic Coulter counter", Review of Scientific Instruments, 2008, 79, pp. 046104-1 to 046104-3.

C-C. Chang; Z-X. Huang; R-J. Yang; "Three-dimensional hydrodynamic focusing in two-layer polydimethylsiloxane (PDMS) microchannels", Journal of Micromechanics and Microengineering, 2007, 17, pp. 1479-1486.

A. Wolff; I. R. Perch-Nielsen; U. D. Larsen; P. Frils; G. Goranovic; C. R. Poulsen, J. P. Kutter; P. Telleman; "Integrating advanced functionality in a microfabricated high-throughput fluorescent-activated cell sorter", Lab Chip, 2003, pp. 22-27.

N. Sundararajan; M. S. Pio; L. P. Lee; A. A. Berlin; Three-Dimensional Hydrodynamic Focusing in Polydimethylsiloxand (PDMS) Microchannels, 2004, 13(4), pp. 559-567.

G. Segre; A. Silberberg; "Radial Particle Displacements in Poiseuille Flow of Suspensions", Nature Publishing Group, 1961, 4760, pp. 209-210.

* cited by examiner

COAXIAL MICROREACTOR FOR PARTICLE SYNTHESIS

CROSS REFERENCE TO RELATED APPLICATIONS

This application claims priority to prior co-pending provisional U.S. Patent Application Ser. No. 61/246,593 originally filed Sep. 29, 2009 entitled "COAXIAL MICROREACTOR FOR PARTICLE SYNTHESIS" from which benefit is claimed.

STATEMENT OF GOVERNMENT INTEREST

This invention was made with Government support under contract no. DE-AC04-94AL85000 awarded by the U.S. Department of Energy to Sandia Corporation. The Government has certain rights in the invention, including a paid-up license and the right, in limited circumstances, to require the owner of any patent issuing in this invention to license others on reasonable terms.

FIELD OF THE INVENTION

This invention pertains generally to method and apparatus for control and manipulation of fluid flow and particularly to method and apparatus that provides true three-dimensional focused fluid flow for improved particle synthesis and manipulation on a microfluidic chip using a coaxial laminar flow mixer.

BACKGROUND

Particle generation using microfluidic systems—even chip-based systems—is not new in and of itself. While nanoparticles in particular appear to have been the subject of much published work in this area (S. Desportes, Z. Yatabe, S. Baumlin, V. Genot, J.-P. Lefevre, H. Ushiki, J. A. Delaire, R. B. Pansu, "Fluorescence lifetime imaging microscopy for in situ observation of the nanocrystallization of rubrene in a microfluidic set-up", *Chemical Physics Letters,* 2007, v.446: pp. 212-216; S. Pabit and J. Hagen, "Laminar-Flow Fluid Mixer for Fast Fluorescence Kinetics Studies", *Biophysical Journal,* 2002, v.83: pp. 2872-2878; H. Nagasawa, T. Tsujiuchi, T. Maki, and K. Mae, "Controlling fine particle formation processes using a concentric microreactor", *America Institute of Chemical Engineers Journal,* 2007, v.21(no. 1): pp. 196-206, 2007; T. L. Sounart, P. A. Safier, J. A. Voigt, J. Hoyt, D. R. Tallant, C. M. Matzke, and T. A. Michalske, "Spatially-resolved analysis of nanoparticle nucleation and growth in a microfluidic reactor", Lab-on-a-Chip, 2007, v.1: pp. 908-915) treatment of micron-sized and larger particles appears to be lacking, presumably due to the difficulties posed by clogging and surface nucleation. Moreover, these prior art examples typically rely on coaxial capillary arrangements external to the microfluidic chip (cf. S. Pabit, op. cit., and H. Nagasawa, op. cit.) or involve irregular flow patterns with chimney-like (H. Klank, G. Goranovic, J. P. Kutter, H. Gjelstrup, J. Michelsen, and C. H. Westergaard, "Ply measurements in a microfluidic 3D-sheathing structure with three-dimensional flow behavior," *Journal of Micromechanics and Microengineering,* 2002, v.12: pp. 862-869) or piecewise-focused geometries (X. L. Mao, J. R. Waldeisen, and T. J. Huang, "'Microfluidic drifting'—implementing three-dimensional hydrodynamic focusing with a single-layer planar microfluidic device," *Lab-on-a-Chip,* 2007, v.2: pp. 1260-1262) poorly suited to uniform particle nucleation and growth.

Microreactors are particularly beneficial for reaction experiments or particle production processes in which either reactants or products are explosive, radioactive, acutely hazardous, extremely costly, particularly rare, or available in only very limited quantities (e.g., materials collected in forensic analysis, etc.) because small quantities of reagents are used and small quantities of waste are generated. Moreover, because reactions occur in an essentially closed system, these techniques may also be particularly applicable or adaptable for work with reagents and products which are reactive to atmospheric air, moisture, etc. Non-aqueous chemistries, organic chemistries, ionic liquid chemistries, etc., may all be adaptable to these reaction schemes.

Microreactors fabricated on-chip using techniques typical of micromachining or lithographic techniques like those employed for the fabrication of integrated circuits, microelectromechanical systems (MEMS), and lab-on-a-chip systems offer a number of advantages over comparable off-chip designs. While similar phenomena and geometries can be achieved in capillary-based systems, blown-glass assemblies, and devices produced by conventional small-scale machining, such systems typically lack the dimensional consistency and economies of scale made possible by the parallelized nature of microfabrication. Moreover, discretely fabricated components can prove problematic to integrate effectively, whereas multiple functionalities can be readily incorporated onto a single chip or micromachined substrate. As such, integrated on-chip designs avoid problems of component interconnection, minimize required sample amounts, decrease dead volumes and transport volumes, reduce sample dispersion, and minimize the number of discrete parts and connections which can potentially fail, clog, or leak.

Continuous, flow-through microfluidic chemical reactors, i.e., microreactors, offer a number of potential benefits over more conventional large-scale and batch processes for the production of particles (nanocrystals, nanoparticles, quantum dots, microparticles, etc.). Specifically, the ability to conduct reactions at scales comparable to the diffusion length with precise control over flow geometry and reaction conditions makes it possible to avoid significant deviations in microenvironment and residence times, which can occur in larger systems. Moreover, as will be shown below, the option to serially engage these microreactors makes it possible to effectively decouple and independently control the processes of nucleation, growth, and particle aggregation while offering options for integrating additional functionalities downstream such as particle sorting or separation, solvent or solute extraction, spectroscopic or light scattering analysis, thermal treatment, surface functionalization, etc.

For the purposes of particle generation, 2-dimensional focusing (or in fact any simple two-dimensional 2- or 3-stream laminar mixing) is less than ideal for two reasons. First, the planar (reacting) interface between the streams contacts the channel wall (i.e., floor and ceiling), tending to result in surface crystal nucleation that can lead a loss of particle uniformity or even clogging. Second, the parabolic velocity profile typical of pressure driven flow in a channel means that particles nucleating at different positions along the planar mixing interface will experience different velocities, residence times, and growth histories, tending to broaden the size distribution of resulting crystals. Alternatives which have previously been explored to improve residence time uniformity include a variety of rapid mixing schemes (S. Hardt, K. S. Drese, V. Hessel, and F. Schonfeld, "Passive micromixers for applications in the microreactor and μTAS fields," Microfluidics and Nanofluidics, 2005, v.1: pp. 108-118) and a suggestion of relying on Taylor dispersion (lateral diffusion) to "average-out" residence times in slow moving flows (S. Krishnadasan, J. Tovilla, R. Vilar, A. J. deMello, and J. C. deMello, "On-line analysis of CdSe nanoparticle formation in a continuous flow chip-based microreactor", *Journal of Materials Chemistry,* 2004, v.14: pp. 2655-2660). Most mixing schemes presented suffer the aforementioned wall nucleation problems, limiting their usefulness for particle production. While the Taylor dispersion concept may work serviceably for nanoparticle production, larger particles will not have the same degree of lateral mobility, and will tend to settle out of the flow at the low velocities required for this approach to work.

Achieving highly symmetrical three-dimensionally-focusable coaxial core/sheath flows on-chip has proven to be a significant challenge due to the largely planar, two-dimensional nature of typical chip fabrication techniques. While the prior art provides examples of coaxial and three-dimensional flow focusing devices, they are generally designed with little concern for end-to-end core/sheath interface uniformity or surface interactions. One of the most common approaches to producing on-chip three-dimensionally focused and/or coaxial flow is the use of piecewise focusing, where the core flow is focused first in the lateral dimension by one sheath flow, then in the vertical direction by another sheath flow, or vice versa (G. Hairer, G. S. Parr, P. Svasek, A. Jachimowicz, and M. J. Vellekoop, "Investigations of micrometer sample stream profiles in a three dimensional hydrodynamic focusing device," Sensors and Actuators B, 2008, v.132: pp. 518-524; R. Scott, P. Sethu, and C. K. Harnett, "Three dimensional hydrodynamic focusing in a microfluidic Coulter counter," *Review of Scientific Instruments.* 2008, v.79: pp. 046104; X. L. Mao, J. R. Waldeisen, and T. J. Huang, (op. cit.); C.-C. Chang, Z.-X. Huang, and R-J Yang, "Three-dimensional hydrodynamic focusing in two-layer polydimethylsiloxane (PDMS) microchannels," *Journal of Micromechanics and Microengineering,* 2007, v.11: pp. 1479-1486). Unfortunately, piecewise focusing of reacting flows guarantees non-uniformity by providing not one but two sequential reacting interfaces. In two of these examples, three-dimensional focusing is further accomplished by forcing the core or sample stream against a wall of the system, producing a non-coaxial flow unsuitable for particle production due to the potential for surface nucleation and clogging (cf. Hairer, op. cit. and R. Scott, op. cit.). Chimney-like geometries have also been presented in which the core flow is introduced from the out-of-plane direction into a substantially two dimensional fluidic system, again yielding a significantly non-uniform reacting interface with distinct upstream and downstream microenvironments near the injection point (H. Klank, G. Goranovic, J. P. Kutter, H. Gjelstrup, J. Michelsen, and C. H. Westergaard, (op. cit.); A. Wolff, I. R. Perch-Nielsen, U. D. Larsen, P. Friis, G. Goranovic, C. R. Poulsen, J. P. Kutter, and P. Telleman, "Integrating advanced functionality in microfabricated high-throughput fluorescent-activated cell sorter," Lab-on-a-chip, 2003, v.3: pp. 22-27). Even more complex device geometries have been suggested, likely to yield even more broadly distributed reaction conditions if applied to the problem of particle generation (N. Sundararajan, M. S. Pio, L. P. Lee, and A. A. Berlin, "Three-dimensional hydrodynamic focusing in polydimethylsiloxane (PDMS) microchannels," *Journal of Microelectromechanical Systems,* 2004, v.13: pp. 559-567).

One of the more uniform coaxial flow geometries suggested for particle generation relies on a pulled capillary sandwiched between a blank coverslip and a molded polydimethylsiloxane (PDMS) layer patterned with microchannels (cf. S. Desportes, op. cit.). While the geometry of this device produces a uniform coaxial flow, the use of the soft PDMS elastomer makes the device more a disposable laboratory prototype than a true, durable, chip-based system. Many resort to PDMS and laminated PDMS structures to address the aforementioned difficulties of producing three-dimensional fluid flows with largely two-dimensional fabrication techniques (cf. R. Scott, op. cit.; C. C. Chang, op. cit.; and N. Sundararajan, op. cit.). The use of PDMS appears primarily to address the need to fabricate a channel of sufficient size to accommodate the capillary tube. The disadvantages of PDMS as an engineering material for micro fluidic systems are numerous and significant: lack of mechanical and dimensional stability, surface chemistry and reactivity, tendency to attract hydrophobic contaminants or particles, shrinkage or swelling due to absorption or interactions with common working fluids and reagents, and poor optical properties rendering PDMS-based systems unsuitable for many applications involving optical diagnostics.

SUMMARY

As discussed above, prior art micro reactor and mixing schemes demonstrate a number of deficiencies when considered for the purpose of particle generation. Accordingly, we have developed a microreactor comprising a novel coaxial laminar flow fluid mixing system disposed on a microfluidic chip for synthesizing particles from solution and various embodiments thereof. The microreactor can comprise one or more coaxial mixing stages which can be arranged singly, in series, in parallel, or nested concentrically in parallel. We have developed a number of approaches, described below, for effectively implementing axially-symmetrical coaxial laminar flows in a microfluidic chip to provide highly uniform diffusional mixing between reacting core and sheath flow streams. These flow geometries are similar to those utilized in flow cytometry and use hydrodynamic focusing to confine a core flow to a small, axially-symmetric, centrally positioned, and spatially well-defined portion of a flow channel cross-section.

The novel microreactor or fluid mixer disclosed and described herein is fabricated in such a way that the substantially planar two-dimensional arrangement of microfluidic channels characteristic of chip-based devices can nevertheless produce three-dimensional coaxial core/sheath flow geometry. Moreover, embodiments of the invention detailed below enable three-dimensional hydrodynamic focusing of the coaxial flow, offering precise control over the geometry of the reacting core/sheath interface. In the present invention, three-dimensional, coaxial, focused flow is made possible by fabricating mixer structures in which the core channel of a three-channel (sheath-core-sheath) mixer is substantially undercut by the sheath channels on either side. This undercut geometry allows fluid from both sheath channels to merge substantially above, below, and upstream of the core flow orifice. As a result, the present invention avoids many practical difficulties and limitations inherent in prior art microreactor particle synthesis systems while enabling advanced on-chip reactor functionality and improving performance. In particular, the highly symmetrical, consistent, and uniform interface between reacting core/sheath species enabled by the present invention is conducive to the production of particles with homogeneous properties and very narrow size distributions, key figures of merit for particles in many applications. We also detail a variety of practical innovations designed to minimize clogging and enable meaningful scale-up of particle production, particularly for particles larger than the nanometer to 10 micron size range most commonly explored in the microreactor literature. In many cases, the approaches and device geometries presented here are also applicable to non-particle-producing reaction processes, the creation of uniform droplets and emulsions, and flow cytometry applications.

While the invention and its various embodiments described herein may be applied to a broad range of fluid flow regimes and schemes, the invention will be illustrated and described generally by means of crystallization processes associated with the precipitation of insoluble or sparingly soluble inorganic salt crystals from aqueous solutions. It is understood that these descriptions are regarded as illustrative of the invention and not as restrictive or limiting.

Beyond inorganic precipitation, however, the invention described herein, as well as its various embodiments, can be applied to particle generation occurring due to factors other than the formation of an insoluble compound, such as changes of state, temperature, etc. Even more generally, this invention is adaptable to compounds or particle production from gas-in-gas reactions, vapor-in-gas reactions, or gas-in-liquid reactions; to non-particle producing reactions occurring purely in the gas or liquid phases; or to the production of coaxial multi phase flow streams yielding droplets, micelles, bubbles, etc.

Here we concern ourselves primarily with control of microfluidic flows occurring "on-chip," which means on a device or substrate typically fabricated and patterned by means of micromachining or lithographic techniques analogous to those employed for the fabrication of integrated circuits, MEMS devices, and lab-on-a-chip systems. While similar phenomena and designs can be achieved in capillary-based systems and those produced by conventional small-scale machining, such systems typically lack the economies of scale made possible by the massively parallel nature of microfabrication. Moreover, discretely fabricated components can prove problematic to integrate effectively, whereas multiple functionalities can be readily incorporated onto a single chip or micromachined substrate, thereby avoiding problems of component interconnection, minimizing required sample quantities, decreasing dead volumes and transport volumes, reducing sample dispersion, and minimizing the number of system parts and connections which can potentially fail, clog, or leak. Thus, our invention is related generally to devices fabricated using "typical" engineering materials—those which are durable and dimensionally consistent enough for mass-production and widespread application. This includes standard micromachining substrates like silicon and semiconductor materials as well as glasses, quartz, and fused silica. We also include ceramics, metals, and durable polymer substrates.

The microreactor or fluid mixing devices disclosed herein can be readily fabricated in quartz, fused silica, or transparent polymer substrates amenable to particle diagnostic techniques such as light scattering, fluorescence imaging, laser-induced fluorescence, or spectroscopy, enabling real-time in-situ characterization, analysis, and quality control of particle generation processes. Silicon substrates can also be used (or silicon-glass hybrid), thereby allowing integration with silicon-based sensing, circuit elements, MEMS devices, etc.

Additional on-chip elements including heaters, thermometers, electrodes, pH sensors, optical components, insulative-dielectrophoresis arrays, sampling channels, inertial particle separation structures, dialysis and ion exchange membranes, magnets/inductors, capacitive sensors, pressure sensors, etc., can be integrated into the coaxial mixers themselves or into upstream, intermediate, or downstream stages to provide added control and on-line monitoring of the particle production process.

Disclosed herein are:

i.) Coaxial core/sheath mixers suitable for integration on-chip with microfabricated devices and lab-on-a-chip systems particularly suited to particle production and cytometry applications.

ii.) Serialization of core/sheath mixers enabling sequential coaxial reactions, staged introduction of reacting species, and the use of intermediate flow lamina to mediate reactions between inner/outer streams, especially to avoid clogs.

iii.) Concentric parallel nesting of core/sheath flow architectures enabling the use of intermediate flow lamina to mediate reactions between inner/outer streams, especially to avoid clogs.

iv.) Parallelization of core/sheath mixers enabling controlled diffusion of reactants between neighboring core flow streams.

v.) A method for avoiding clogs due to flow stagnation during transient operations (i.e. shut-down) based on queuing reactants and flushing liquids serially, then delivering them in a continuous, uninterrupted stream.

BRIEF DESCRIPTION OF THE DRAWINGS

FIG. 5A shows a half-mixer where the lateral walls defining the boundary between core and sheath channels is untapered, while FIG. 5B shows tapering of these lateral walls.

FIG. 6A shows a half-mixer for which both etches are comparable in extent, while FIG. 6B shows a half-mixer for which the second etch is substantially deeper than the first.

FIG. 8A shows a half-mixer where the lateral walls defining the boundary between core and sheath channels are untapered, while FIG. 8B shows tapering of these lateral walls. FIG. 8C illustrates the preferred embodiment of the invention in which the lateral walls defining the boundary between core and sheath channels have been tapered and the relative extent of anisotropic and isotropic etches have been selected to minimize the surface area of the face surrounding the core orifice.

FIG. 10A shows a half-mixer in which only the sides of the core channel pillar are undercut, while FIG. 10B shows a half-mixer in which only the face of the core channel pillar is undercut.

FIG. 11A shows a general overview of a chip-based system featuring serially arrayed mixers. FIG. 11B shows the serial arrangement of individual mixing junctions and the production of a multiply-focused multi-layer coaxial flow.

FIG. 12A provides an overview of a basic 5-channel microfluidic nested parallel mixing design. FIG. 12B illustrates this design extrapolated to include an arbitrary number of outer sheath channels. FIG. 12C shows two-sheath hydrodynamic focusing in the mixing junction of a nested 5-channel design.

FIG. 13A shows a design in which the inner core channel ends prior to the emergence of the inner sheath into the downstream channel. FIG. 13B shows a design in which both inner core and inner sheath channels emerge into the downstream channel at the same axial plane.

FIG. 14A shows the overall arrangement of a 2-core, 3-sheath mixer. FIG. 14B shows parallel hydrodynamic focusing of neighboring core flow streams. FIG. 14C shows a parallel double-core/sheath mixer fabricated using the approach of FIG. 8A.

FIG. 15A shows the flushing liquid being emptied from the driving pump. FIG. 15B shows the aspiration of a reagent bolus into the holding volume. FIG. 15C shows the continuous delivery of the reagent bolus followed immediately by a volume of flushing liquid to the reactor or mixer downstream. FIG. 15D shows the refilling of the driving pump with flushing liquid in preparation for a follow-up purge of the holding volume and downstream system, or repetition of the cycle beginning with FIG. 15A.

DETAILED DESCRIPTION OF EMBODIMENTS OF THE INVENTION

Figure 1:
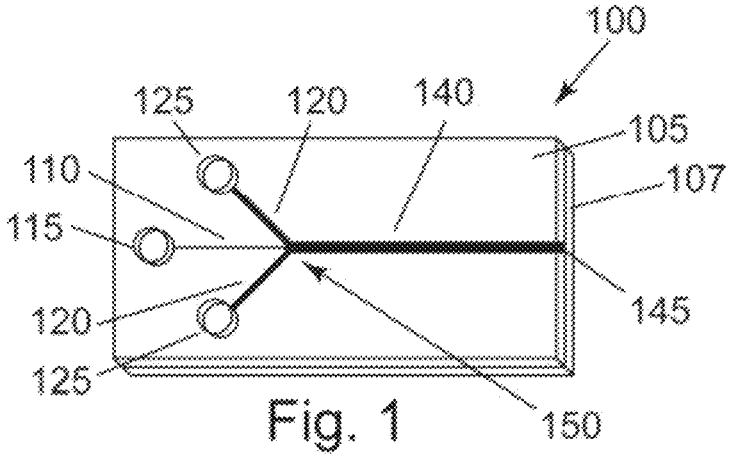
FIG. 1 shows a basic on-chip microfluidic system.

The object of the present invention will become apparent to those of skill in the art from the following description wherein there is shown and described, by way of illustration, one or more modes and embodiments best suited to carry out the invention. Accordingly, the descriptions and drawings provided herein are regarded as illustrative in nature and not to be construed as restrictive.

DEFINITION OF TERMS

As used herein, "channel" refers to a structure wherein a fluid may flow. A channel may be a capillary, tube, conduit, tunnel, or the like. "Microfluidic" refers to a system or device having one or more fluidic channels, conduits or chambers that are generally fabricated at the centimeter to nanometer scale. Thus, "microfluidic channels" or "microchannels" typically have cross-sectional dimensions ranging from about 10 nm to about 1 mm.

As used herein, "chip" or "microchip" refers to a substantially planar substrate or a laminate of substantially planar layers onto or into which features, devices, or systems are patterned, machined, or otherwise fabricated, typically by additive or subtractive micromachining methods. "On-chip" refers to features, devices, or systems fabricated on the surfaces or within the layers of such a microchip substrate. "Microfluidic chip" refers to any such chip-based system incorporating one or more channels of microfluidic dimension. "Lab-on-a-chip" refers to a microfluidic chip-based system incorporating one or more functionalities realized on-chip.

As used herein, "microfabrication" or "micromachining" refers generally to a broad class of techniques, methods, and technologies for producing patterns, devices, or systems with minimum feature sizes ranging from nanometers to millimeters, particularly as applied to the fabrication of on-chip devices and systems. Examples include but are not limited to: photolithographic patterning and masking, electron beam lithography, ultraviolet and deep ultraviolet lithography, laser cutting and ablation, thin film deposition, focused ion beam milling, sputter or evaporative deposition, surface functionalization and self-assembly processes, chemical and plasma etching, chemical vapor deposition, nanoimprint lithography and pattern transfer, molecular beam epitaxy, casting and micromolding, substrate bonding, oxidation and annealing, ion implantation and doping, electroplating and electrodeposition, electrical discharge machining, powder blasting, ultrasonic drilling, precision micromilling, and the like.

As used herein, "focusing" or "flow focusing" refers to the reduction in spatial extent or cross-section of one fluid stream in a channel or other confined space by the introduction of one or more additional fluid streams. "Hydrodynamic focusing" refers more specifically to the focusing of liquid streams or fluids in a substantially laminar flow regime. In a planar (2D) fluidic device, flow focusing is typically accomplished by flowing three streams together into a fluidic junction in which three inlet channels intersect and flow into an outlet channel. Two high-velocity "sheath" streams enter the junction on either side of a lower-velocity central "core" stream. Viscous forces at the core-sheath interfaces rapidly accelerate the core fluid to the velocity of the sheath, effectively elongating or stretching the core flow in the axial direction. As a result, the core stream decreases in width, appearing to be squeezed (i.e. focused) between the two sheath streams in the lateral transverse (i.e. cross-channel) direction. "Two-dimensional focusing" or "2D-focusing" refers to this squeezing of a central flow stream in only one transverse direction, either laterally (substantially in the plane of the substrate) or vertically (substantially normal to the plane of the substrate). "Three-dimensional focusing" or "3D-focusing" refers to the squeezing of a central flow stream in both lateral and vertical transverse directions. Properly implemented, three-dimensional focusing can enable the production of coaxial core-sheath flows having an axially symmetric core-sheath interface.

As used herein, "coaxial" refers to two or more flow streams which are substantially concentric or centered about a shared axis in the direction of overall axial fluid motion. Considering the cross-section of a fluid flow channel, an inner core fluid stream positioned substantially at the center of the channel would be considered coaxial with an outer sheath fluid stream centered nominally about that same central point. Two or more flow streams can be coaxial without the interface between them exhibiting axial symmetry. We concern ourselves with axial symmetry only in relation to the interface(s) between flow lamina in core-sheath flow configurations and not in relation to the geometry of the fluid channel itself.

As used herein, a "fluid" refers to a continuous substance that tends to flow and to conform to the outline of a container such as a liquid or a gas. Fluids include aqueous and non-aqueous liquids, gases, and solutions including dissolved soluble constituents, mixtures, emulsions, suspensions including insoluble dispersed or entrained constituents, colloids, oils, solvents, ionic fluids or molten salts, air, energetic plasmas, and the like. Fluids also include biological and bodily fluids such as cytoplasm, saliva, mucus, blood, plasma, urine, bile, milk, lymph, cerebrospinal fluid, and the like. Fluids can also exist in a thermodynamic state near the critical point, as in supercritical fluids.

As used herein, "particle" refers to any discrete phase or material, chemical, or biological entity distinct and/or distinguishable from the fluid in which it is suspended, dispersed, emulsified, mixed, entrained, or otherwise situated. Particles include but are not limited to powder, dust, soot, micro- and nanobeads, micro- and nanoparticles, micro- and nanocrystals, micro- and nanorods, micro- and nanofibers, micro- and nanospheres, micro- and nanotubes, colloids, quantum dots, droplets, bubbles, aerosols and mists, gels, micelles and reverse-micelles, aggregates and agglomerates of smaller subunits, and the like. Particles may be polymers, ceramics, glasses, oxides, oils, hydrocarbons, graphene, buckminsterfullerene, carbon nanotubes, organic or inorganic compounds or complexes, coordination or chelate complexes, salts, minerals, organometallic compounds, metal-organic frameworks, metals including aluminum, arsenic, beryllium, cadmium, chromium, cobalt, copper, iridium, iron, lead, manganese, mercury, nickel, platinum, selenium, scandium, silver, titanium, uranium, vanadium, and the like, alloys and multiphase solid mixtures, heterogeneous and composite materials, semiconductors including silicon, germanium, gallium arsenide, silicon carbide, cadmium selenide, dielectric insulators, and the like. Particles can be macromolecules, amino acids, peptides, proteins, glycoproteins, nucleotides, nucleic acid molecules, carbohydrates, lipids, lectins, cells, viruses, viral particles, bacteria, organelles, liposomes, spores, protozoa, yeasts, molds, fungi, pollens, diatoms, synthetic or engineered biological assemblies, and the like, toxins, biotoxins, hormones, steroids, immunoglobulins, antibodies, supermolecular assemblies, ligands, and the like. Particles may be catalytic materials, zeolites, dyes, lubricants, chemical warfare agents, explosives, propellants, agents used in explosives and propellants, environmental pollutants, pesticides, insecticides, pharmaceuticals, and the like.

As used herein, "crystallization" refers generally to the process and various sub-processes involved in the formation of a new solid phase from a fluid phase, or the modification of that solid phase after its initial nucleation. As such, crystallization is understood for our purposes to encompass all particle formation processes regardless of whether their product is crystalline in nature. Crystallization sub-processes principally consist of nucleation and growth, but can also depend upon concurrent and/or competitive processes such as attrition, aggregation, agglomeration, dissolution, changes of state, etc. The interplay of these various factors in the crystallization process ultimately determines the character, morphology, and size distribution of resulting particles.

As used herein, "nucleation" refers to the initial stage of a crystallization or particle growth process in which molecules in a fluid phase coalesce to form a solid phase particle of sufficient size and persistence that it does not immediately re-dissolve. As used herein, "growth" refers generally to the process by which particle nuclei increase in size as additional material from the fluid phase coalesces around the existing nuclei causing them to increase in physical extent, typically from the nanometer scale to micrometer size or larger.

As used herein, "microreactor", "microfluidic reactor", "flow mixer" or "fluid flow mixer" singly or in some combination thereof will be used interchangeably and synonymously.

As used herein, "hydraulic diameter" refers approximately to the cross-sectional dimensions of a fluid channel which is not necessarily circular in cross-section. Hydraulic diameter is conventionally defined as four times the cross sectional area of a channel divided by the wetted perimeter of the cross section. For filled circular channels, the diameter and hydraulic diameter are identical. For our purposes, hydraulic diameter will be used when comparing relative channel sizes when terms like diameter, depth, width, or height are ambiguous or not readily applicable due to channel geometry.

Introduction to the Embodiments of the Invention

The invention disclosed herein consists of a laminar flow mixer on a microfluidic chip that can produce a coaxial flow arrangement suitable for use in particle synthesis microreactor applications, flow cytometry, or chemical analysis applications.

Providing context for the discussion of the embodiments of the invention to follow, FIG. 1 depicts a general and non-restrictive, representative schematic overview of a planar three-stream microfluidic system 100 typical of chip-based microreactor and flow cytometry applications. Said microfluidic system consists of a bonded assembly of a top substrate 105 and a bottom substrate 107. Fluidic channels and features are patterned or fabricated onto one or both substrates so that enclosed microfluidic channels are formed between them. Microfluidic system 100 further comprises a system of such channels including a central core channel 110 and two sheath channels 120, all of which meet at a fluidic junction, confluence, or mixer 150. Flow entering said mixer from said core and sheath channels proceeds into a downstream channel 140. Fluid is introduced into core channel 110 through a core inlet 115, while fluid is introduced into sheath channels 120 through sheath inlets 125. Flow in downstream channel 140 leaves the microfluidic system through downstream outlet 145. In FIG. 1, core inlet 115 and sheath inlets 125 are depicted as holes, vias, ports, or surface fluidic connections otherwise made through top substrate 105 and/or bottom substrate 107 to the underlying microchannels. Downstream outlet 145 is depicted as an opening, port, orifice, or fluidic edge connection otherwise made on the peripheral surface of microfluidic system 100, where downstream channel 140 emerges between top substrate 105 and bottom substrate 107. Any combination of top or bottom surface or edge connections is appropriate for said inlets and said outlet in such a microfluidic system, and such connections to external fluid handling devices or systems may be readily implemented by techniques common to the art.

While FIG. 1 presents a very simple microfluidic design for illustrative purposes, mixer elements 150 can be incorporated into much more complex microfluidic systems with very different channel layouts, multiple inlets or outlets, inlets or outlets shared by multiple channels or coupled to external manifolds, branching or intersecting channels, or fluidic junctions delivering the output of the mixer to multiple downstream channels 140, and the like. In a real-world implementation, for example, it could be beneficial for fluid entering sheath channels 120 to be delivered through a single, common, or shared sheath inlet 125 to assure that sheath flow is delivered to mixer 150 in symmetrical fashion.

Figure 2A:
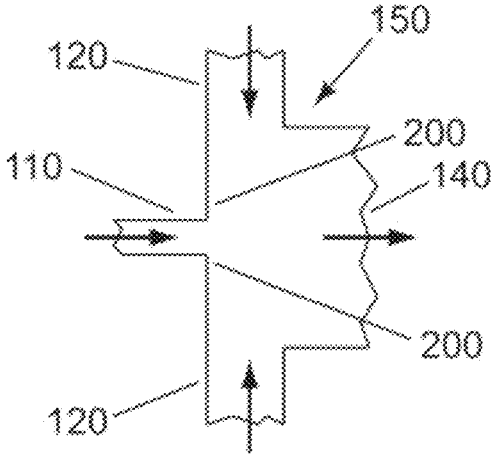
FIG. 2A through 2D show plan-view schematics of several three-channel microreactor fluidic junction configurations 150 illustrated in FIG. 1.
Figure 2B:
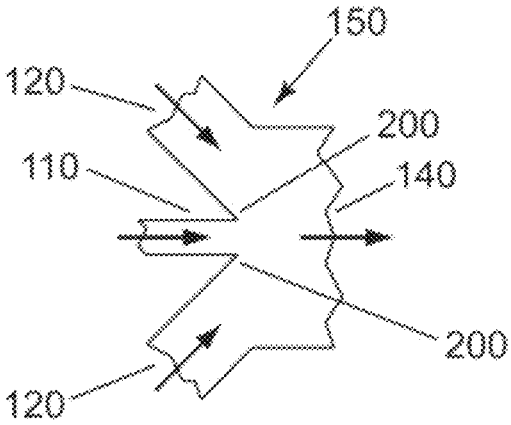
Figure 2C:
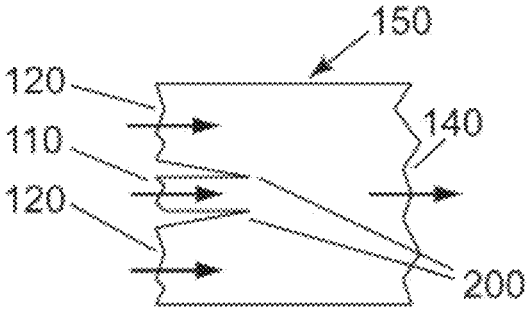
Figure 2D:
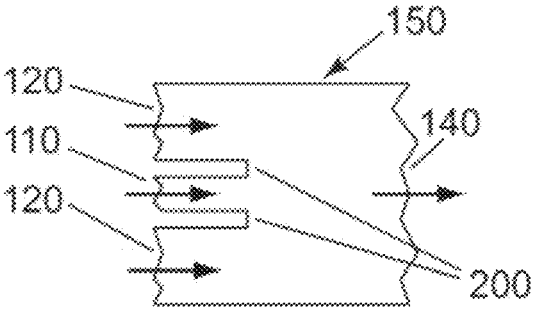
Figure 3A:
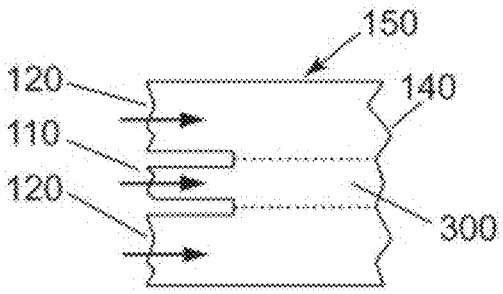
FIG. 3A through 3F illustrate hydrodynamic focusing and defocusing for parallel and orthogonal core and sheath channels.
Figure 3D:
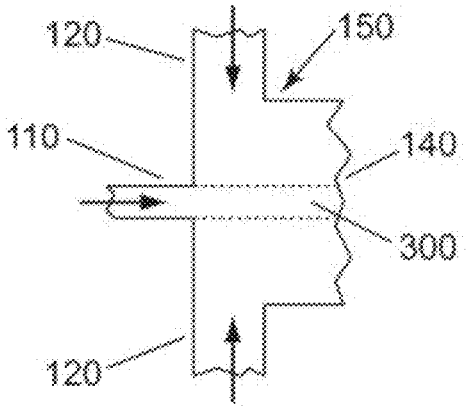
Figure 3B:
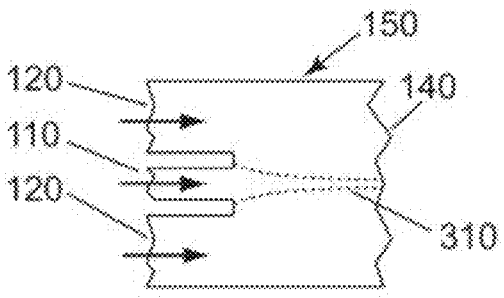
Figure 3E:
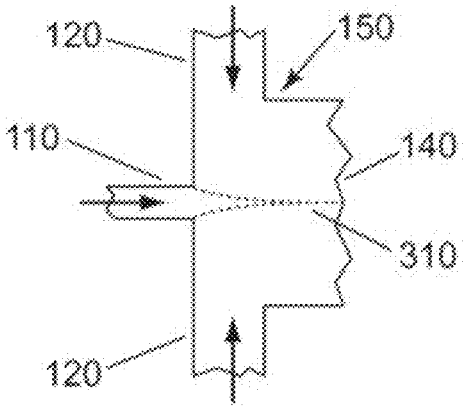
Figure 3C:
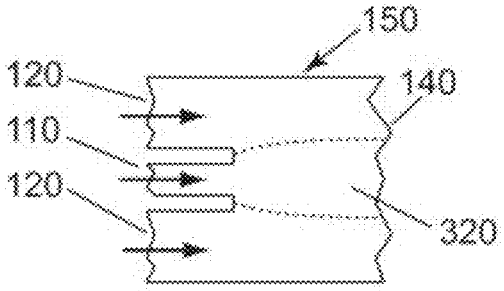
Figure 3F:
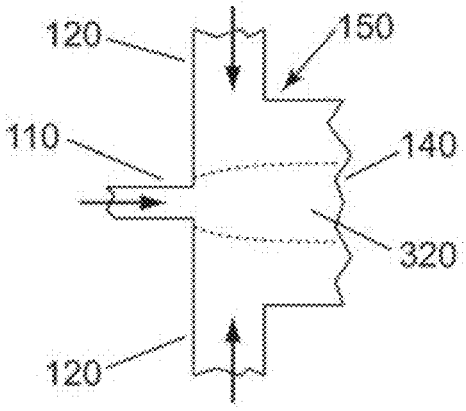

Providing further context for the discussion to follow, FIGS. 2A through 2D depict close-up generalized plan-view configurations possible for fluidic junction or mixer 150. Sheath channels 120 are assumed to intersect core channel 110 in substantially symmetrical fashion before merging at mixer 150 into downstream channel 140. A flanking wall 200 to either side of core channel 110 defines the geometry around which fluid from core channel 110 and sheath channels 120 must flow before interacting. FIG. 2A shows sheath channels 120 meeting core channel 110 at right angles. FIG. 2B shows sheath channels 120 meeting core channel 110 at an acute angle. FIG. 2C shows sheath channels 120 meeting core channel 110 at a highly acute angle in which flanking wall 200 is tapered to a point and both core and sheath channels are substantially parallel before meeting in mixer 150. FIG. 2D shows an alternative configuration in which core channel 110 and sheath channels 120 are parallel as they enter mixer 150, but flanking wall 200 is not tapered. In practice, the minimum width of flanking wall 200 as depicted in FIG. 2C and FIG. 2D is determined largely by the surface area required to successfully bond or seal the flanking wall feature when top and bottom substrates are joined to form combined microfluidic system.

The concept of hydrodynamic focusing is illustrated schematically in FIG. 3 for representative parallel (FIGS. 3A, 3B, 3C) and orthogonal (FIGS. 3D, 3E, 3F) mixing junctions. In FIGS. 3A and 3D, core and sheath flow streams enter mixer 150 with equal velocities, yielding an unfocused core stream 300 with core/sheath interface dimensions comparable to those of core channel 110. In FIGS. 3B and 3E, the flow velocity in sheath channels 120 is much larger than the velocity of core channel 110. In this case, viscous drag rapidly accelerates the core flow stream, effectively squeezing it in the lateral transverse dimension and elongating it in the axial direction to produce a hydrodynamically focused core stream 310. In this simplified example, focused core stream 310 is said to be two-dimensionally focused (i.e. only focused in the lateral and axial dimensions). A core stream focused in the vertical dimension (i.e. out-of-plane) as well as laterally and axially is said to be three-dimensionally focused. In FIGS. 3C and 3F, flow in core channel 110 initially has a higher velocity than that in sheath channels 120. As a result, viscous drag between core and sheath rapidly decelerates the core flow, causing it to expand in the lateral dimension and producing a defocused core stream 320.

Figure 4A:
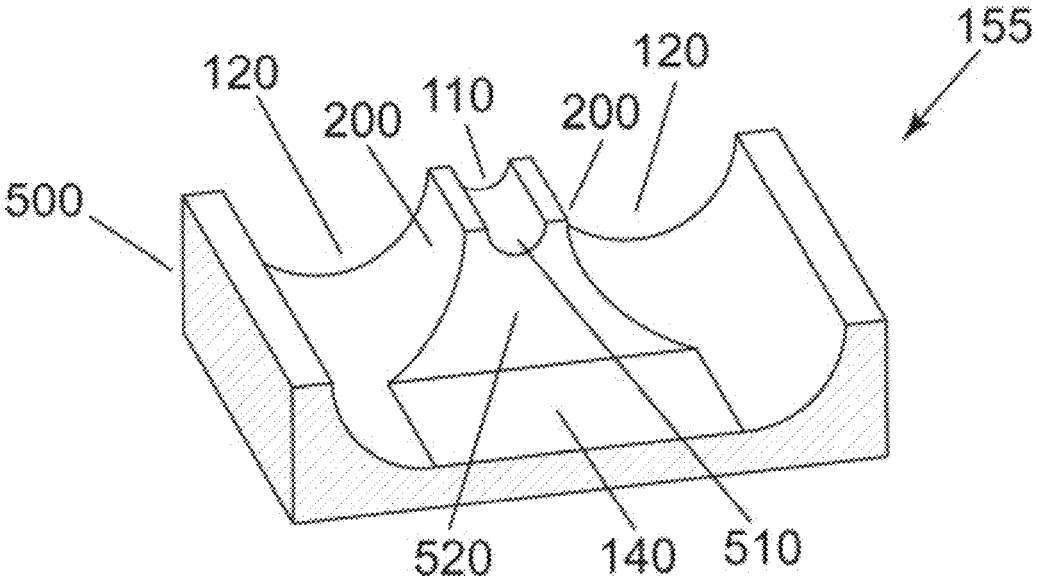
FIG. 4A shows one of the two core/sheath coaxial mixer half-sections with channel cross-sections characteristic of fabrication by isotropic etching.
Figure 4B:
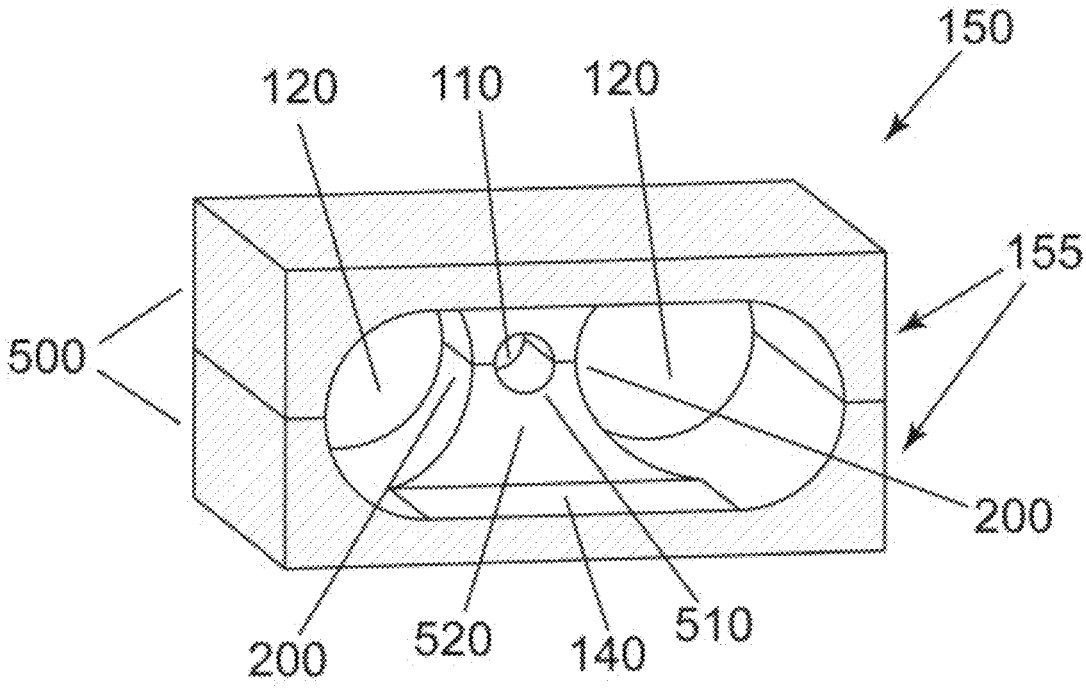
FIG. 4B shows the fully assembled core/sheath mixer section with channel cross-sections characteristic of fabrication by isotropic etching.

The embodiment of FIG. 4 provides a first representation of an on-chip coaxial mixer section, with FIG. 4A showing the geometry of a single half mixer section 155 and FIG. 4B illustrating the joining of two substantially identical copies of said half mixer section in mirror image to create a complete mixer 150, as previously referenced in the discussion of FIGS. 1 through 3. This approach of symmetrically assembling mirrored half mixer sections 155 to form full mixers 150 is to be assumed for all subsequent embodiments of the invention described in FIGS. 4, 5, 6, 8, 10, 13, and 14. As such, following the discussion of the embodiment of FIG. 4, only half mixer sections 155 are presented explicitly.

Full mixer 150 in FIG. 4B, and by inference any full/complete mixer assembled from half mixer sections 155 depicted in the various embodiments of FIG. 4, 5, 6, 8, 10, 13, or 14, is assumed to be fabricated and to function in the context of a microfluidic system functionally resembling the system 100 depicted in FIG. 1. As such, the embodiments of FIGS. 4, 5, 6, 8, 10, 13, and 14 share a common fluidic architecture referencing the channel arrangements and nomenclature of FIGS. 1 and 2. All embodiments of FIGS. 4, 5, 6, 8, 10, 13, and 14 include a central core channel 110 and two symmetrically-disposed sheath channels 120 to either side of said core channel. Core channel 110 and sheath channels 120 merge into downstream channel 140 defining a fluidic junction, confluence, or mixer 150, understood to comprise two mirrored half mixer sections 155 in a fully assembled system. Core channel 110 is separated from sheath channels 120 on either lateral side by flanking walls 200. Core channel 110 emerges into downstream channel 140 through an outlet, opening, or orifice 510 in the downstream wall or core channel face 520 defined by the geometry of said orifice and the two flanking walls 200. The details of additional features specific to the embodiments of FIGS. 4, 5, 6, 8, 10, 13, and 14 are discussed in the appropriate subsections below.

Similarly, the mixer embodiments of FIGS. 4, 5, 6, 8, 10, 13, and 14 operate in common according to the general scheme described in the discussion of FIGS. 2 and 3, but here considering the three-dimensional structure of the mixers. One fluid is introduced into mixer 150 through central core channel 110, while a second fluid is introduced through sheath channels 120 to yield a substantially coaxial flow arrangement in downstream channel 140. The relative merits of the various embodiments of FIGS. 4, 5, 6, 8, 10, 13, and 14 with respect to the formation of coaxial, axially symmetrical, and/or hydrodynamically focused flow are discussed in the appropriate subsections below.

Embodiment

Isotropically Patterned—FIG. 4

FIG. 4 depicts an embodiment of the invention illustrating oblique views of on-chip half-mixer section 155 and full mixer 150. Channel geometries in the embodiment of FIG. 4 are characteristic of those produced by lithographic patterning and isotropic etching.

FIG. 4A shows a half-mixer section 155 comprising a substrate 500 patterned with a central core channel 110 and two symmetrically-disposed sheath channels 120 to either side of said core channel. Core channel 110 and sheath channels 120 merge into downstream channel 140 defining a fluidic junction or mixer 150. Core channel 110 is separated from sheath channels 120 on either side by flanking walls 200. Core channel 110 emerges into downstream channel 140 through an outlet, opening, or orifice 510 in the downstream wall or core channel face 520 defined by the geometry of said orifice and the two flanking walls 200. In the embodiment of FIG. 4A, core channel face 520 is narrowest at the central axis of mixer 150, broadening and curving downstream as face 520 extends into downstream channel 140. FIG. 4B shows a section of mixer 150 comprising the final assembly of two half-mixer substrates 500 disposed opposite one another in mirror image to produce a bi-axially symmetric fluidic structure.

The geometry of the embodiment of FIG. 4 may be produced by various means, but most directly lends itself to fabrication by lithographic patterning and isotropic etching processes well established in the art (e.g. the etching of glass by hydrofluoric acid solutions, etc.). A first lithographic mask defines the geometry of the shallow etch which will create core channel 110. A second lithographically patterned mask then protects said core channel while defining the geometry of the deeper etch which will create sheath channels 120 and downstream channel 140. Two half-mixer substrates 500 thus patterned are then bonded to each other in mirror image.

In operation, the embodiment of FIG. 4 follows the common architecture described above and in the discussion of FIGS. 1 through 3. The applicants have shown by fluid dynamic simulation that while the embodiment of FIG. 4 can produce laterally-focused, non-axisymmetric coaxial flow, the isotropically-etched geometries of flanking walls 200 and core channel face 520 prevent this embodiment from achieving true three-dimensional hydrodynamic focusing, as focusing in the vertical dimension is simply not possible for typical or readily-fabricated dimensions of core channel 110 and sheath channel 120. Moreover, the combination of the parabolic fluid velocity profiles in sheath channels 120 with the flow geometry resulting from the sloping surfaces of core channel face 520 and flanking walls 200 are such that core flow emerging from orifice 510 tends to remain partially attached to the contour of core face 520, causing elongation of the core flow cross section in the vertical dimension even as it is focused in the lateral dimension. At higher sheath-to-core flow rate ratios normally expected to enhance hydrodynamic focusing, the core flow can in fact be deflected entirely against core face 520 (floor and ceiling), destroying even the marginally coaxial character of the core/sheath flow present at lower sheath-to-core flow ratios. Detachment of the core flow from core face 520 to produce a substantially more axially-symmetric core/sheath cross section is only achievable for ratios of sheath channel 120 diameter to core channel 110 diameter substantially on the order of 10:1 or more.

Embodiment

Anisotropically Patterned—FIG. 5

FIG. 5 depicts two embodiments of the invention illustrating oblique views of an on-chip half-mixer section 155. Channel geometries in the embodiments of FIG. 5 are characteristic of those produced by lithographic patterning and anisotropic etching.

Figure 5A:
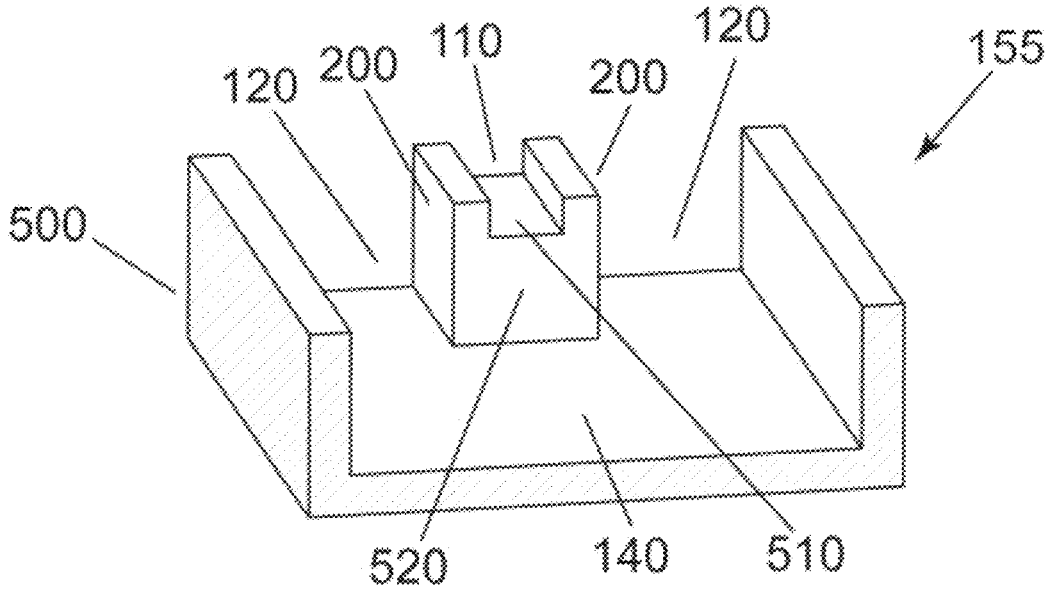
FIGS. 5A and 5B show two core/sheath coaxial mixing junctions with channel cross-sections characteristic of fabrication by anisotropic etching.
Figure 5B:
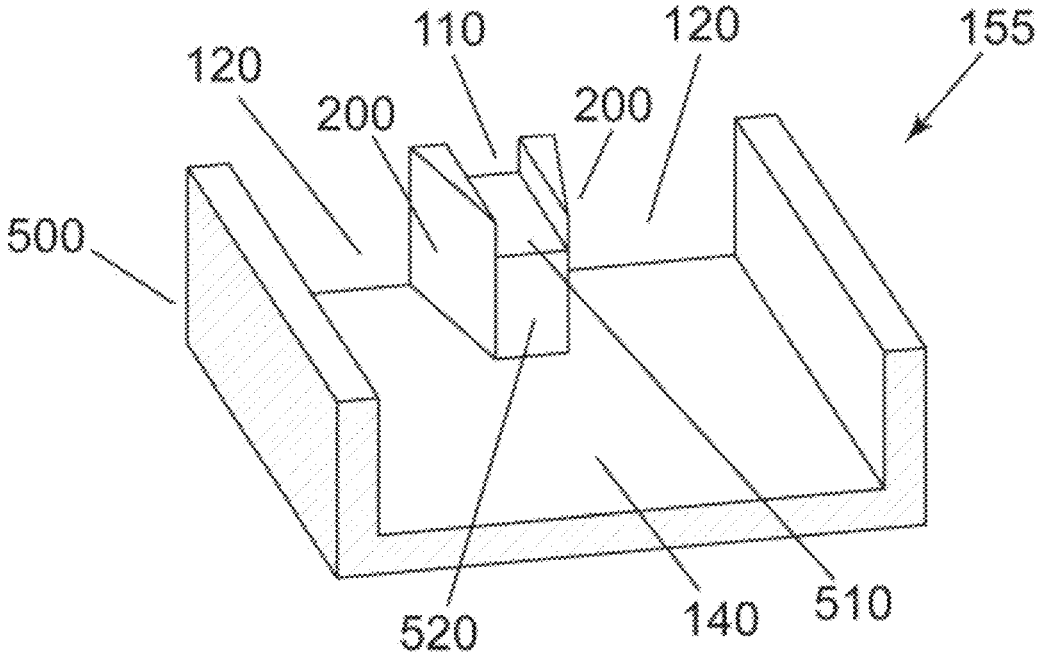

FIG. 5A shows a substrate 500 patterned with a central core channel 110 and two symmetrically-disposed sheath channels 120 to either side of said core channel. Core channel 110 and sheath channels 120 merge into downstream channel 140 defining a fluidic junction or mixer 150. Core channel 110 is separated from sheath channels 120 on either side by flanking walls 200. Core channel 110 emerges into downstream channel 140 through an outlet, opening, or orifice 510 in the downstream wall or core channel face 520 defined by the geometry of said orifice and the two flanking walls 200. In the embodiment of FIG. 5A, core channel face 520 presents substantial surface area both below and to the sides of orifice 510. FIG. 5B replicates the parts and features of FIG. 5A, with the exception that the plan-view pattern used to define flanking walls 200 is tapered to a point at the plane of core channel face 520 and core channel orifice 510. As a result, core channel face 520 as rendered in the embodiment of FIG. 5B presents substantial surface area only below core orifice 510.

The geometry of the embodiments of FIG. 5 may be produced by various means, but most directly lends itself to fabrication by lithographic patterning and anisotropic etching processes well established in the art (e.g. plasma etching of silicon by deep reactive ion etch or alternating etch/passivation "Bosch" processes, etc.). A first lithographic mask defines the geometry of the shallow etch which will create core channel 110. A second lithographic mask then protects said core channel while defining the geometry of the deeper etch which will create sheath channels 120 and downstream channel 140. Two half-mixer sections 155 thus patterned are bonded to each other in mirror image in the manner of FIG. 4B.

In operation, the embodiments of FIG. 5 follow the common architecture described above and in the discussion of FIGS. 1 through 3. The applicants have shown by fluid dynamic simulation that like the isotropically-etched embodiment of FIG. 4, the embodiments of FIG. 5 can produce laterally-focused, nominally coaxial flow under typical laminar flow conditions but cannot achieve true three-dimensional focusing of the core flow cross-section for typical, readily-fabricated dimensions of core channel 110 and sheath channels 120. Unlike the embodiment of FIG. 4, the embodiments of FIG. 5 show significant improvement in the detachment of core flow emerging from orifice 510 from core channel face 520, largely due to the absence of the gradually sloped surface characteristic of the flanking walls 200 and core channel face 520 in the embodiment of FIG. 4. Moreover, the tapering of the flanking walls 200 in the embodiment of FIG. 5B reduces the downstream surface area of core channel face 520, thereby reducing the flow stagnation area adjacent to core orifice 510 and substantially improving the lateral geometry of the core/sheath interface in the vicinity of orifice 510. As Reynolds numbers increase, the tapering of said flanking walls also helps to delay the onset of vorticity, enabling tapered designs to sustain stable coaxial operation at substantially higher Reynolds numbers than untapered designs like the embodiment of FIG. 5A.

Embodiment

Undercut via Sequential Isotropic Patterning—FIG. 6

FIG. 6 depicts two embodiments of the invention illustrating oblique views of an on-chip half-mixer section 155. Channel geometries in the embodiments of FIG. 6 are characteristic of those produced by lithographic patterning and a novel two-stage sequential isotropic etching process illustrated in FIG. 7. This two-stage etching process is employed to improve coaxial flow character and core/sheath symmetry.

Figure 6A:
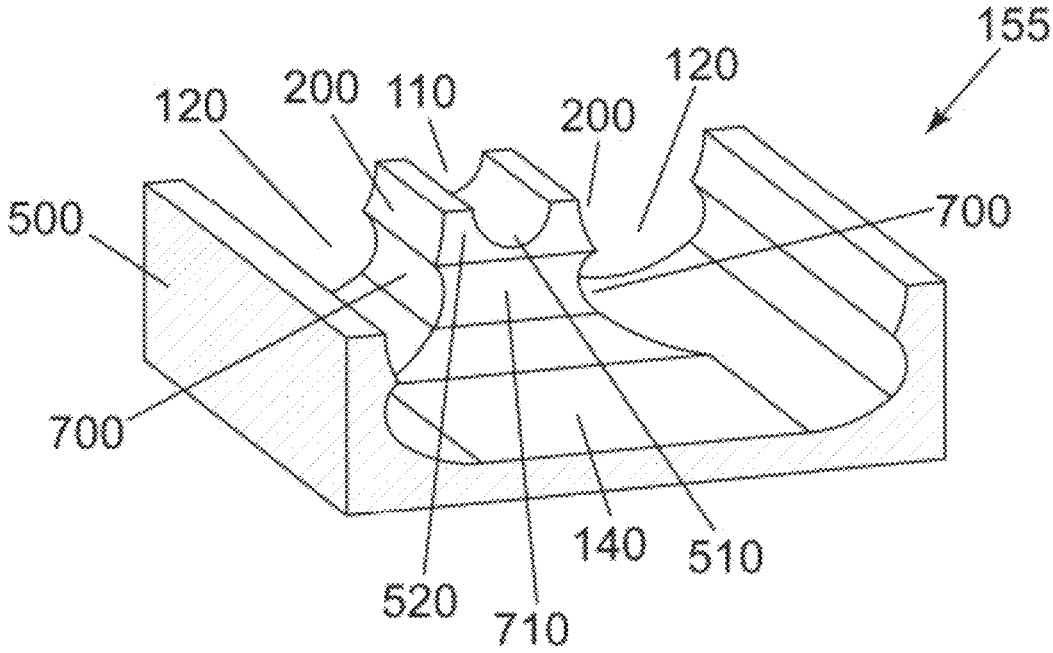
FIGS. 6A and 6B show two core/sheath coaxial mixing junctions with channel cross-sections characteristic of fabrication by two sequential isotropic etches.
Figure 6B:
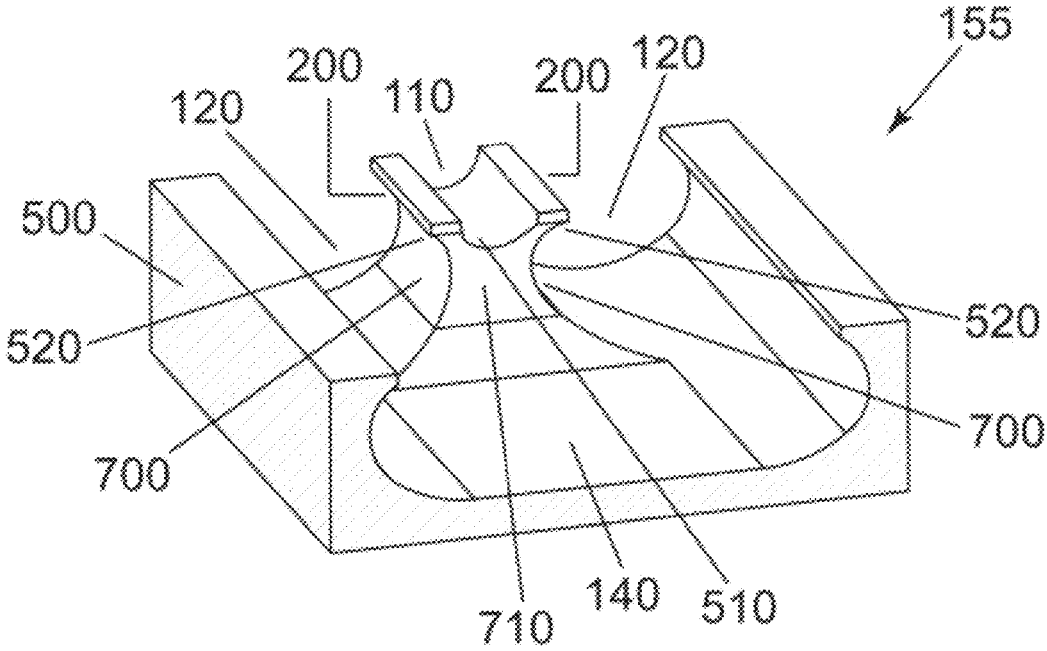

FIG. 6A shows a substrate 500 patterned with a central core channel 110 and two symmetrically-disposed sheath channels 120 to either side of said core channel. Core channel 110 and sheath channels 120 merge into downstream channel 140 defining a fluidic junction or mixer 150. Core channel 110 is separated from sheath channels 120 on either side by flanking walls 200. The base or lower portion of each of said flanking walls is undercut in the lateral direction during fabrication, resulting in two hollows, concavities, or flanking wall undercuts 700. The same fabrication process undercuts core channel face 520 yielding a hollow, concavity, or face undercut 710 on this downstream surface. Core channel 110 emerges into downstream channel 140 through an outlet, opening, or orifice 510 in the downstream wall or core channel face 520 defined by the geometry of said orifice, the two flanking walls 200, the flanking wall undercuts 700, and the face undercut 710. In the embodiment of FIG. 6A, the depth/extent of face undercut 710 and flanking wall undercuts 700 is comparable to the depth/extent of the initial patterning step used to define sheath channels 120 and flanking walls 200. In the embodiment of FIG. 6B, face undercut 710 and flanking wall undercuts 700 are substantially greater in depth/extent than the initial patterning step used to define sheath channels 120 and flanking walls 200. As a result, core channel face 520 and flanking walls 200 are comparatively very small in both surface area and vertical dimension as depicted in FIG. 6B. In either embodiment depicted in FIG. 6, tapering of the plan-view pattern defining lateral flanking walls 200 in the manner of the embodiment of FIG. 5B may be desirable to further minimize the area of core channel face 520.

Figure 7:
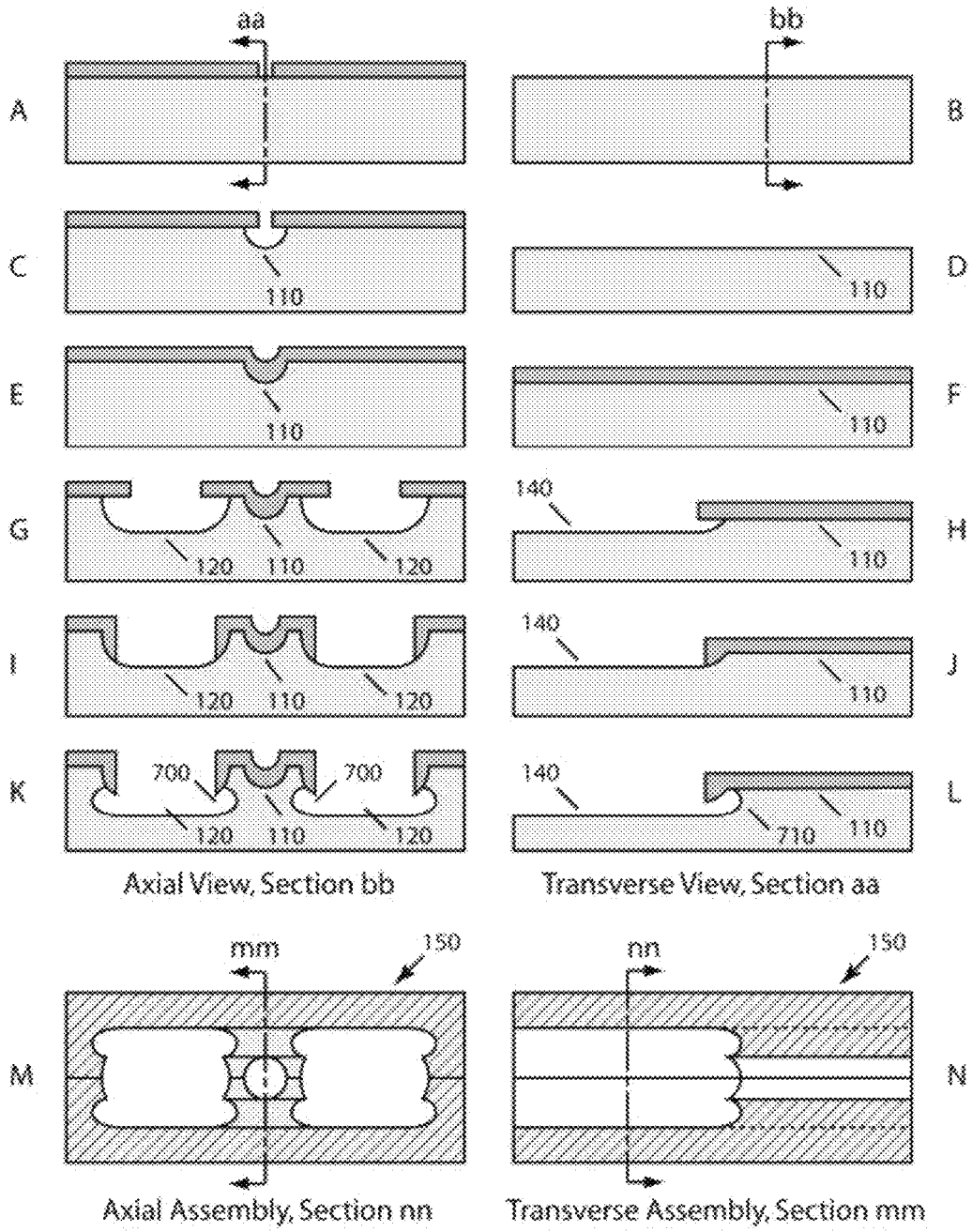
FIGS. 7A through 7N shows a sample process for fabricating a coaxial mixer like that depicted in FIG. 6A or 6B.

The geometry of the embodiment of FIG. 7 may be produced by various means, but most directly lends itself to fabrication by a novel adaptation of lithographic patterning and isotropic etching processes otherwise well known in the art (e.g. the etching of glass by hydrofluoric acid solutions, etc.) as depicted in FIG. 7 for axial and lateral sections. In FIGS. 7A and 7B, a first lithographic masking layer (e.g. photoresist and/or lithographically patterned thin film masking materials, etc.) is patterned to define the geometry of core channel 110. In FIGS. 7C and 7D, the core channel and a portion of what will become downstream channel 140 are formed by isotropic etching. In FIGS. 7E and 7F, the first lithographic masking layer is removed, and a second masking layer is deposited to protect core channel 110. In FIGS. 7G and 7H, the second masking layer is patterned and etched to form what will become sheath channels 120 and downstream channel 140. At this point, one of at least two options may be employed: 1) the second masking layer can be heated and melted or "reflowed" in place to cover and protect the side-walls of sheath channels 120 and downstream channel 140, or 2) the second masking layer can be removed and a third masking layer deposited and patterned to expose the bottoms of sheath channels 120 and downstream channel 140 while protecting their side-walls. The result of either option is depicted in FIGS. 7I and 7J. Next, the device is isotropically etched, undercutting the side-wall protecting masking layer in sheath channels 120 and downstream channel 140 to yield the flanking wall undercuts 700 depicted in FIG. 7K and face undercut 710 depicted in FIG. 7L. The side-wall protecting masking layer is removed, and two patterned substrates are bonded together in mirror-image to form completed mixer section 150 depicted in FIGS. 7M and 7N.

In operation, the embodiments of FIG. 6 follow the common architecture described above and in the discussion of FIGS. 1 through 3. The applicants have shown by fluid dynamic simulation that like the isotropically-etched embodiment of FIG. 4, the embodiment of FIG. 6A, in which first and second isotropic etch steps are substantially equal in depth/extent, can produce laterally-focused, nominally coaxial flow under typical laminar flow conditions but cannot achieve true three-dimensional focusing of the core flow cross-section. In contrast, the embodiment of FIG. 6B, in which the second isotropic etch step is substantially greater in extent/depth than the first, is able to produce a limited degree of vertical hydrodynamic focusing in addition to laterally-focused, nominally coaxial flow. As in the embodiments of FIG. 5, the embodiments of FIG. 6 demonstrate improvement in the detachment of core flow emerging from orifice 510 from core channel face 520, but the superposition of sequential isotropically etched contours only partially addresses the difficulties originally observed for the embodiment of FIG. 4. Moreover, the extreme face undercut 710 present in the embodiment of FIG. 6B, altering the geometry of core orifice 510, yields a substantially non-uniform, asymmetrical interface geometry where core and sheath flows first interact.

Preferred Embodiment

Undercut via Sequential Anisotropic & Isotropic Patterning—FIG. 8

Figure 8A:
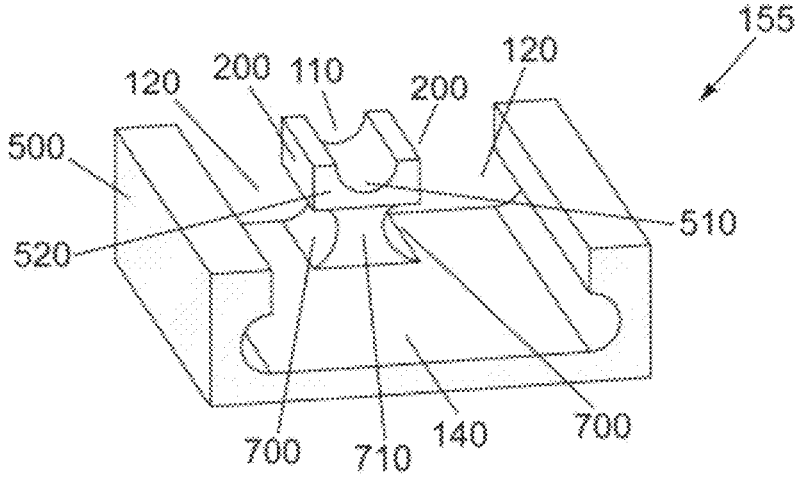
FIGS. 8A through 8C show a core/sheath coaxial mixing junction with channel cross-sections characteristic of fabrication by sequential anisotropic and isotropic etches.
Figure 8B:
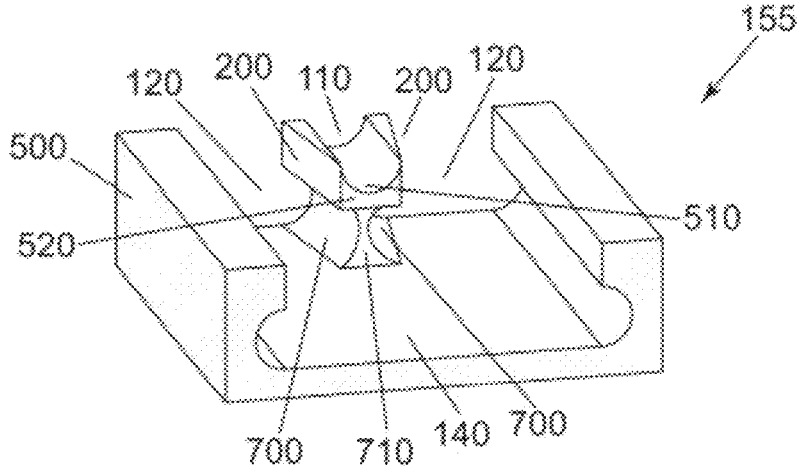
Figure 8C:
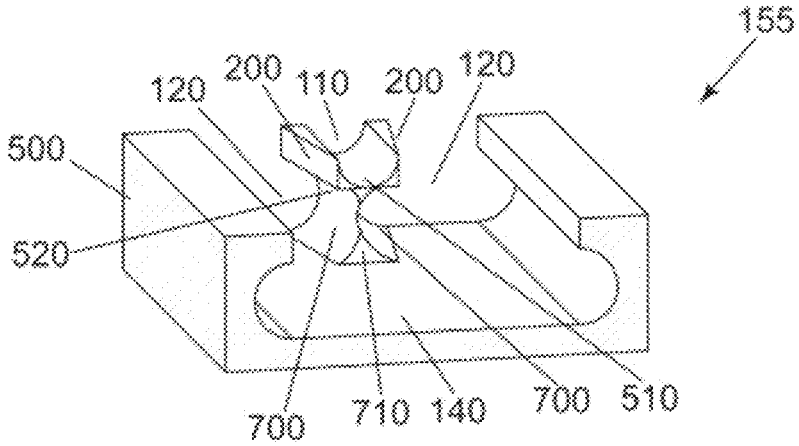

FIG. 8 depicts three embodiments of the invention illustrating oblique views of an on-chip half-mixer section 155. Channel geometries in the embodiments of FIG. 8 are characteristic of those produced by lithographic patterning and a two-stage process involving sequential anisotropic and isotropic etches illustrated in FIG. 9. This two-stage etching process seeks to improve coaxial flow and symmetry by better approximating an idealized coaxial structure while addressing the focusing and flow geometry limitations of the embodiments of FIG. 6. FIG. 8C represents the current preferred embodiment of the present invention.

FIG. 8A shows a substrate 500 patterned with a central core channel 110 and two symmetrically-disposed sheath channels 120 to either side of said core channel. Core channel 110 and sheath channels 120 merge into downstream channel 140 defining a fluidic junction or mixer 150. Core channel 110 is separated from sheath channels 120 on either side by flanking walls 200. The base or lower portion of each of said flanking walls is undercut in the lateral direction during fabrication, resulting in two hollows, concavities, or flanking wall undercuts 700. The same fabrication process undercuts core channel face 520 yielding a hollow, concavity, or face undercut 710 on this downstream surface. Core channel 110 emerges into downstream channel 140 through an outlet, opening, or orifice 510 in the downstream wall or core channel face 520 defined by the geometry of said orifice, the two flanking walls 200, the flanking wall undercuts 700, and the face undercut 710.

In the embodiment of FIG. 8A, flanking walls 200 are untapered in the plan view, and core channel face 520 presents substantial surface area both below and to the sides of orifice 510. The embodiment of FIG. 8B replicates the parts and features of the embodiment of FIG. 8A, with the exception that the plan-view pattern used to define flanking walls 200 is tapered to a point at the plane of core channel face 520 and core channel orifice 510. As a result, core channel face 520 as rendered in the embodiment of FIG. 8B presents substantial surface area only below core orifice 510. The embodiment of FIG. 8C carries this line of thought to its logical conclusion, showing both tapered flanking walls 200 and a core channel face 520 presenting minimal surface area adjacent to core orifice 510. This result is achieved by adjusting the relative depth/extent of the fabrication processes used to define the core channel 110, flanking walls 200, flanking wall undercuts 700, and face undercut 710. The embodiment of FIG. 8C represents the currently preferred embodiment of the invention as it offers minimal flow perturbation in the vicinity of the core/sheath mixing point and most closely replicates an "ideal" coaxial geometry.

Figure 9:
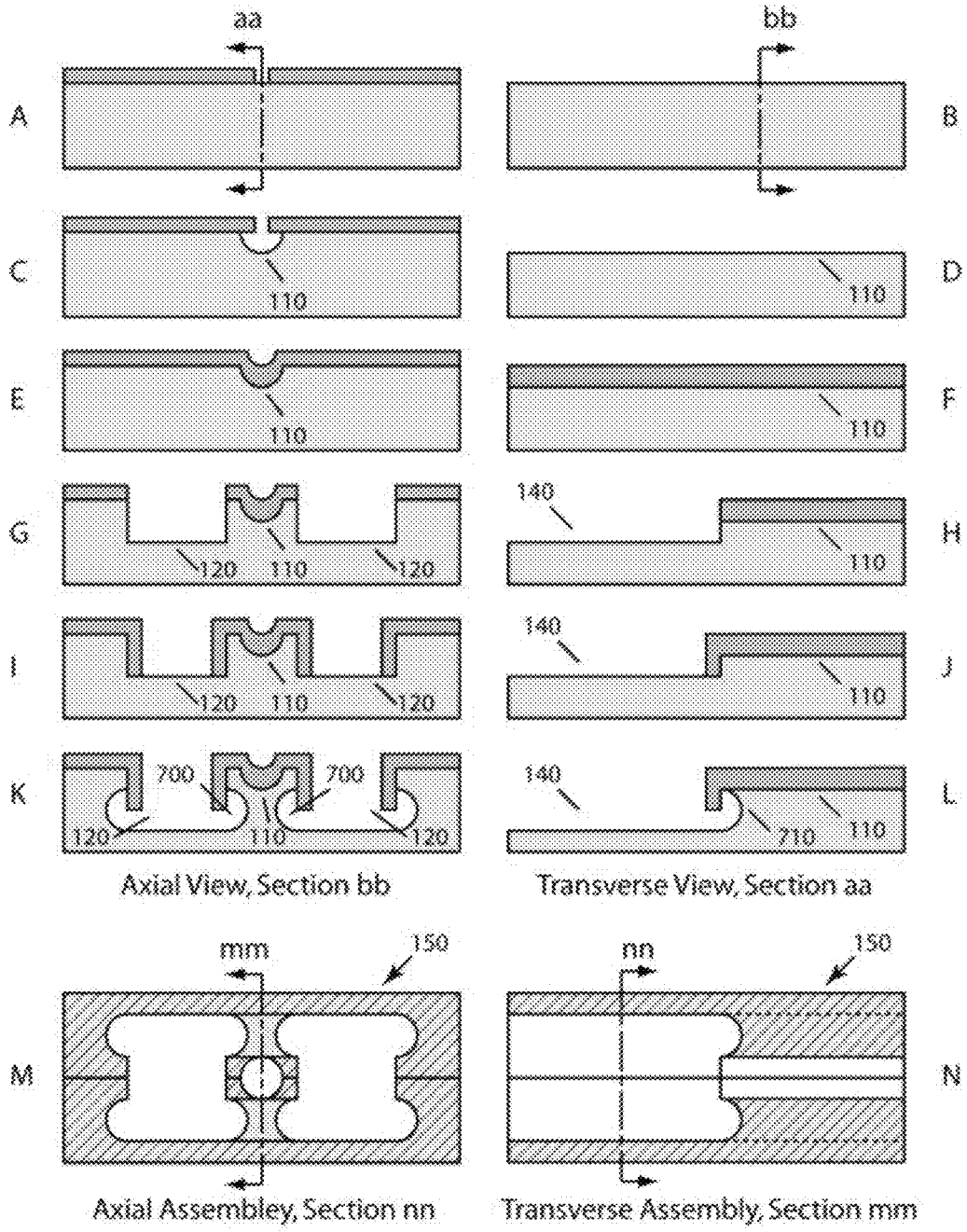
FIGS. 9A through 9N shows a sample process for fabricating a coaxial mixer like that depicted in FIG. 8.

The geometry of the embodiments of FIG. 8 may be produced by various means, but most directly lends itself to fabrication by a novel adaptation of lithographic patterning and etching processes otherwise well known in the art (e.g. anisotropic plasma etching and isotropic wet etching of glass by hydrofluoric acid solutions, or anisotropic plasma etching and isotropic plasma or wet etching of silicon by hydrofluoric/nitric/acetic acid solutions, etc.) as depicted in FIG. 9 for axial and lateral sections. In FIGS. 9A and 9B, a first lithographic masking layer (e.g. photoresist and/or lithographically patterned thin film masking materials, etc.) is patterned to define the geometry of core channel 110. In FIGS. 9C and 9D, the core channel and a portion of what will become downstream channel 140 are formed by isotropic etching. In FIGS. 9E and 9F, the first lithographic masking layer is removed, and a second masking layer is deposited to protect core channel 110. In FIGS. 9G and 9H, the second masking layer is patterned and etched anisotropically to form what will become sheath channels 120 and downstream channel 140. At this point, the second masking layer is removed and a third masking layer is deposited and patterned to expose the bottoms of sheath channels 120 and downstream channel 140 while protecting their side-walls as shown in FIGS. 9I and 9J. Next, the device is isotropically etched, undercutting the side-wall protecting masking layer in sheath channels 120 and downstream channel 140 to yield the flanking wall undercuts 700 depicted in FIG. 9K and face undercut 710 depicted in FIG. 9L. The side-wall protecting masking layer is removed, and two patterned substrates are bonded together in mirror-image to form the completed mixer section 150 depicted in FIGS. 9M and 9N.

In operation, the embodiments of FIG. 8 follow the common architecture described above and in the discussion of FIGS. 1 through 3. The applicants have shown by fluid dynamic simulation that the embodiments of FIG. 8 enable the production of not only laterally-focused coaxial core/sheath flow, but also a true three-dimensionally focused core/sheath interface offering a high degree of axial symmetry. Moreover, by tapering the lateral flanking walls 200 as in FIGS. 8B and 8C and by minimizing the area of core channel face 520 as in the preferred embodiment of FIG. 8C, the mixer may be operated at higher Reynolds numbers without producing vortices, enabling higher throughput operation while retaining core/sheath interface uniformity.

Embodiment

Non-Uniform Undercut—FIG. 10

FIG. 10 depicts two embodiments of the invention illustrating oblique views of an on-chip half-mixer section 155. Channel geometries in the embodiments of FIG. 11 are analogous to those of the embodiment of FIG. 8, but suggest two-stage anisotropic and isotropic lithographic patterning in which the undercutting step either occurs with some directional dependence or is performed only on selected channel surfaces.

Figure 10A:
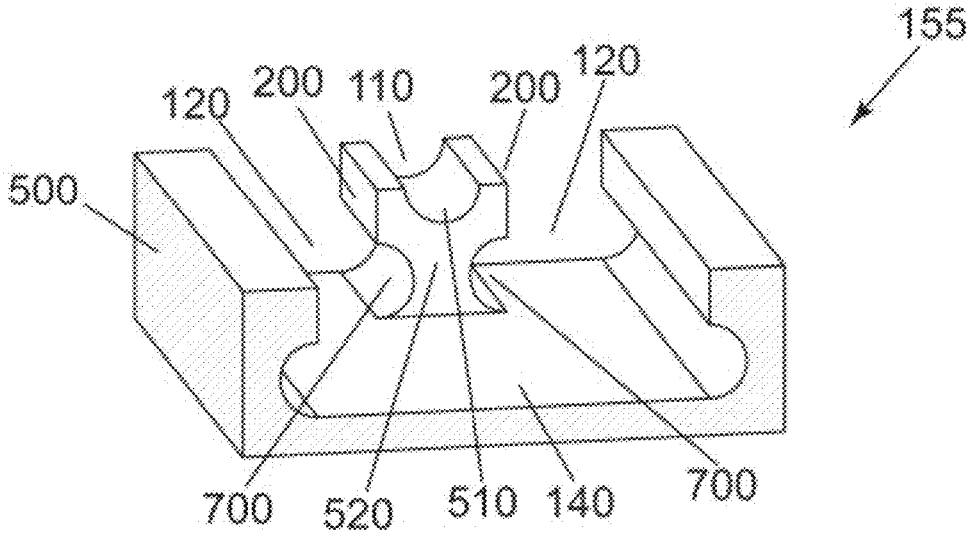
FIGS. 10A and 10B show two variations on the geometry of the mixer shown in FIG. 8A.
Figure 10B:
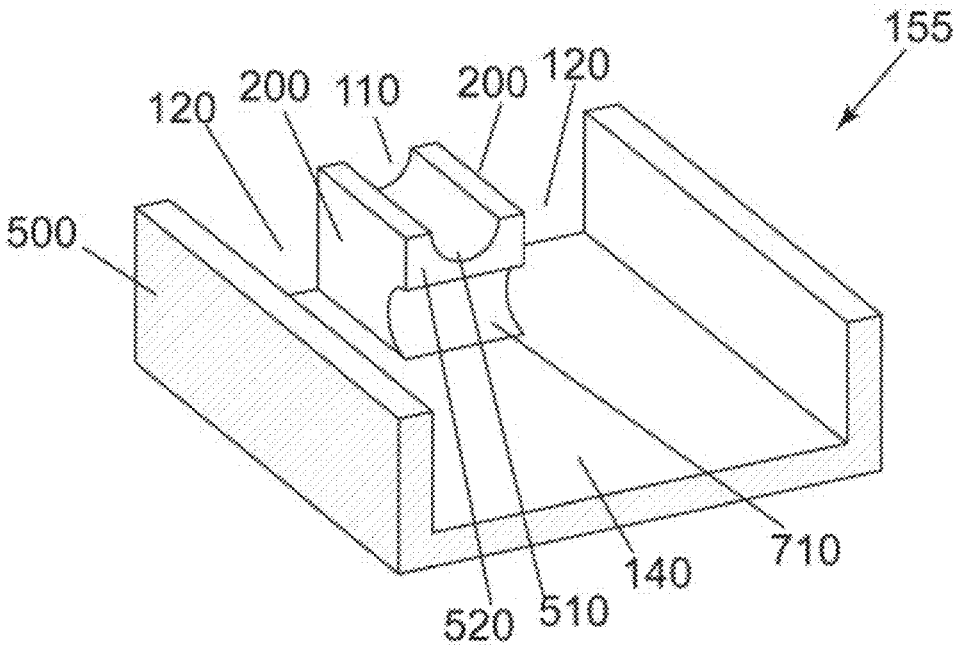

FIG. 10A shows a substrate 500 patterned with a central core channel 110 and two symmetrically-disposed sheath channels 120 to either side of said core channel. Core channel 110 and sheath channels 120 merge into downstream channel 140 defining a fluidic junction or mixer 150. Core channel 110 is separated from sheath channels 120 on either side by flanking walls 200. The base or lower portion of each of said flanking walls is undercut in the lateral direction during fabrication, resulting in two hollows, concavities, or flanking wall undercuts 700. In the example of FIG. 10A, directionality or selectivity of the undercut fabrication process does not produce undercutting of the core channel face 520. FIG. 10B illustrates the analogous case in which the directionality or selectivity of the undercutting process yields a hollow, concavity, or face undercut 710 only below the downstream core channel face 520 with no corresponding undercutting of the flanking walls 200.

The geometry of the embodiments of FIG. 10 may be produced by various means, but most directly lends itself to fabrication by lithographic patterning and etching processes otherwise well known in the art and analogous to those described for the embodiments of FIG. 8.

In operation, the embodiments of FIG. 10 follow the common architecture described above and in the discussion of FIGS. 1 through 3. The applicants have shown by fluid dynamic simulation that like the embodiments of FIG. 8, the embodiments of FIG. 10 can produce not only laterally-focused coaxial core/sheath flow, but also a three-dimensionally focused core/sheath interface. As shown, the embodiments of FIG. 10, and in particular FIG. 10A, show core channel faces 520 of significant area, presenting a stagnation zone and substantially increasing the tendency for vortex formation at higher Reynolds numbers. As in the discussion of the embodiments of FIG. 8, tapering of the lateral flanking walls 200 and adjusting the relative extent of the side undercuts 700 or face undercut 710 in the embodiments of FIG. 10 can help minimize the area of core channel face 520, smoothing core/sheath mixing and improving reaction uniformity.

Embodiment

Coaxial Mixer Serialization—FIG. 11

The inventors have observed that in many 2-component precipitation reactions where reactants are introduced through core channel 110 and sheath channels 120, nucleation and crystal growth frequently occurred at the initial point of reagent interaction: the downstream surface 520 of core channel 110. This kind of mixing-point crystallization is most pronounced for particles precipitated at relatively high super-saturations (i.e., high reagent concentrations relative to the final solubility of the precipitated compound), compounds with relatively fast reaction/precipitation kinetics, and materials that preferentially nucleate on surfaces. Rapid particle nucleation at the mixing point is highly undesirable as it almost invariably results in clogging of the system, disruption of downstream flow uniformity, and dramatic variations in the morphology and size distribution of any crystals recovered. These complications also affect the operation of the coaxial mixing embodiments described above.

In order to overcome the problem of mixing-point crystallization, the inventors have developed a sequential staged coaxial mixer depicted in FIG. 11. The sequential staged coaxial mixer comprises a plurality of coaxial mixers arranged in serial fluidic communication such that the coaxial core/sheath outflow of each upstream mixer becomes the core flow input of the next mixer downstream, and so forth. Any of the coaxial mixer embodiments described in FIG. 4, 5, 6, 8, or 10, any combination of these embodiments, any functionally equivalent coaxial mixer of a design not considered here, or any combination thereof can be arranged in fluidic series to create a sequential staged coaxial mixer.

Figure 11A:
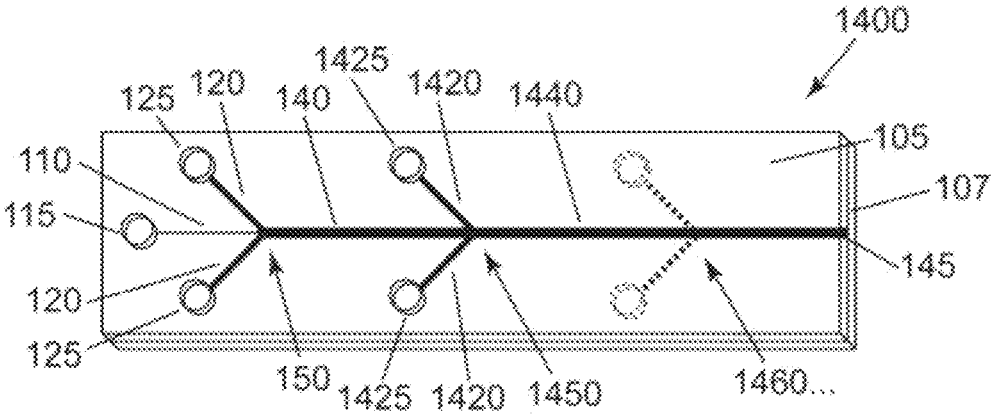
FIGS. 11A and 11B illustrate a coaxial flow mixer consisting of multiple core/sheath mixing junctions arranged in series.

FIG. 11A shows schematically a generalized on-chip microfluidic embodiment of a sequential staged coaxial flow mixer 1400. As in the microfluidic system overview of FIG. 1, microfluidic channels are fabricated within top substrate 105 and bottom substrate 107. A first mixing stage includes a core flow inlet 115 through which fluid is delivered to core flow channel 110. Sheath flow inlets 125 likewise deliver fluid to first-stage sheath channels 120. The core and first-stage sheath channels merge at a first fluid junction or mixer 150 before proceeding into downstream channel 140. The fluid flowing in downstream channel 140 becomes the core flow into a second mixing stage, merging at a second fluid junction or mixer 1450 with sheath fluid from second-stage sheath channels 1420 introduced to the chip through second-stage sheath inlets 1425. The combination of core/first-sheath/second-sheath flows in second mixer 1450 proceeds downstream either into the core channel of subsequent mixing stages 1460, etc., or exits the system through downstream outlet 145. Using this basic configuration a plurality of coaxial mixers may be cascaded in series to form a sequential staged coaxial mixer 1400 with an arbitrary number of core/sheath mixing stages.

Figure 11B:
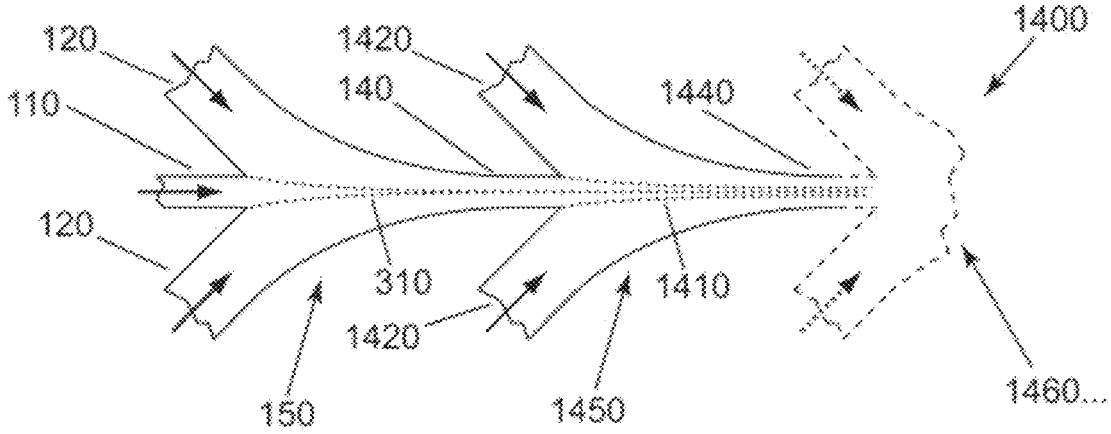

FIG. 11B illustrates schematically in two dimensions how flow focusing in a sequential staged coaxial mixer 1400 can produce multilayered concentric coaxial flows. Here, core fluid flow enters first mixer 150 through core channel 110 and is hydrodynamically focused by fluid flowing from adjacent first-stage sheath channels 120 into focused first-stage core/sheath stream 310. Focused first-stage core/sheath stream 310 retains its focused coaxial flow geometry as it proceeds with its surrounding sheath fluid through downstream channel 140 and into second-stage mixer 1450. In second-stage mixer 1450, the first-stage core/sheath fluid stream 310 and its surrounding first-stage sheath are focused by the influx of sheath fluid from second-stage sheath channels 1420, yielding second-stage core/sheath/sheath stream 1410. The core/sheath/sheath flow stream then proceeds through second-stage downstream channel 1440 into subsequent mixing stages 1460, etc., or exits the system. By modulating the flow rates of successive coaxial mixing stages to hydrodynamically focus or defocus the incoming core flow streams, a high degree of control can be exerted over the cross-sectional dimensions of the multi-layered coaxial flow stream.

In addition to providing intervening fluid layers to moderate chemical reaction processes, the use of sequential staged coaxial core/sheath mixers enables progressive or incremental downstream modification of particles produced by upstream mixers. Introduction of additional reactants to an otherwise fully-reacted stream bearing particles offers one approach for growing those particles to a larger size. Downstream coaxial mixers can also provide sequential surface treatments or functionalization of particles in the central flow stream. Alternately, staged serial mixers can enable the production of heterogeneous composite particles, where seed crystals of one material are precipitated in an upstream mixer, providing a substrate for the nucleation and growth of a different material in downstream reactor/mixer stages.

A further benefit of sequential staged coaxial mixers arises from the observation that particles in some pressure driven flow regimes will naturally tend to congregate due to hydrodynamic forces into a narrow annular region as a function of their size and flow conditions (G. Segre and A. Silberberg, "Radial particle displacements in Poseiulle flow of suspensions," *Nature,* 1961, v.189 (no. 4760): pp. 209-210). This fact may be exploited in a system using sequentially staged mixers. By matching the dimensions of the core/sheath interface to this annular region, uniformity may be enhanced by assuring that growing particles remain localized at the reacting interface to serve as seeds on which subsequent growth due to diffusion of the reacting species can occur. Alternately, it may be desirable to position the reacting interface either inside or outside this annular congregation region to allow new nuclei to form independent of older crystals and migrate inward or outward as they grow to some final size. The interplay between reacting interface, hydrodynamic particle segregation, and the tendency of non-axially-symmetric particles to align themselves with respect to a flow stream also provides opportunities for synthesis of novel elongated or composite structures, particularly in cases where multiple staged sheath flows are employed. Alternately, these influences may be used to promote the growth of highly axially-symmetric particles.

The spatial arrangement of particle-laden flow lamina and subsequently added sheath flows can be altered or even inverted by varying mixer orifice geometry and microchannel design progressively from stage to stage. For example, as a centrally positioned particle-laden flow emerges from a mixer core into a sheath of Reactant A, particles will gradually distribute themselves radially toward their preferred position on outlying streamlines. When a second sheath is introduced (perhaps inert) and a second flow expansion provided, particles will again redistribute themselves outward, effectively migrating by stages from their original positions in the core (now dominated by Reactant A) to their final positions in the sheath. When a final sheath flow of Reactant B is introduced, the particles will already be positioned optimally at the interface to seed the reaction between Reactant A in the core and Reactant B in the outer sheath. The relative rates of diffusion versus particle migration in these successively sheathed and re-sheathed particle-bearing flows as they undergo radial contraction and expansion will determine in which flow regimes this approach is likely to be most successful.

Sequentially staged coaxial microreactors or fluid mixers offer other options for manipulating the particle growth and development process. Once focused at the centerline by passage through a coaxial mixing structure like the embodiments of FIG. 4, 5, 6, 8, or 10, the expansion or contraction of a sheath flow around this centralized particle stream offers two notable opportunities to influence particle development. First, in the same way that hydrodynamic focusing of a particle-laden core flow stream elongates it axially, increases axial inter-particle spacing, and reduces its radial extent, rapidly expanding or defocusing such a flow will tend to compress it axially and decrease inter-particle spacing, potentially promoting particle-particle interactions, aggregation, and/or agglomeration. The effect of rapidly focusing or defocusing particle laden flows either hydrodynamically or through manipulations of channel geometry may also be enhanced depending on particle size and density. Smaller, heavier particles may be less likely to disperse radially in a rapidly dilating flow, whereas larger, low density particles dominated by viscous drag are more likely to track a rapidly diverging streamline in a flow dilation.

Expanding or contracting the sheath flow around a centrally focused particle-laden stream in a serial reactor provides a means to control the rate at which sheath reactants arrive at the core-bound particle stream, effectively moderating the crystal growth process. In a wide channel, growth may occur in a transport-limited regime as reactants in the outer reaches of the sheath take longer to reach the central particle stream. When the channel narrows, the furthest extent of the outer reactant stream may fall within the effective diffusion length of the stream under those conditions, corresponding to a much more rapid arrival of reacting species at the crystal stream and crystal growth which is kinetically limited rather than transport limited. Modulation of the flow between these transport regimes provides opportunities to construct novel heterostructured particles possessing alternating concentric layers of material characteristic of transport- and kinetically-limited growth, in addition to those composite structures made possible through the more general serialization of mixing operations described above.

Embodiment

Figure 12A:
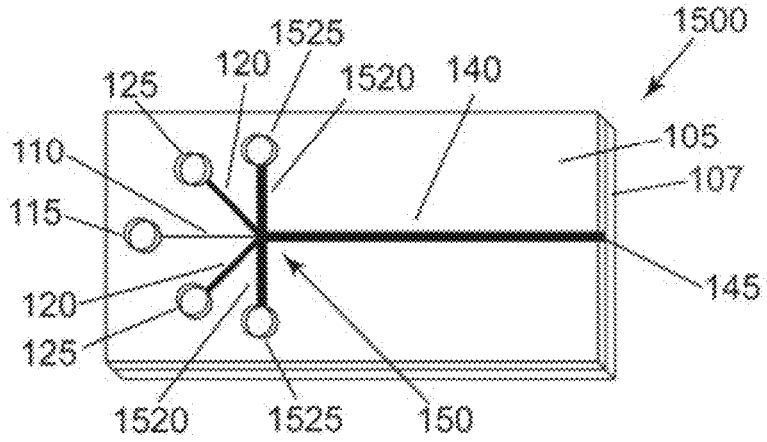
FIGS. 12A through 12C illustrate nested concentrically parallel mixing configurations.

Concentrically Nested Parallel Mixing—FIGS. 12 & 13

In addition to the sequential staged coaxial mixer described above, multi-layered concentric coaxial flow arrangements can also be produced through parallelization of basic on-chip coaxial flow embodiments like those of FIG. 4, 5, 6, 8, or 10. Because these designs enable the production of coaxial flows from a substantially planar arrangement of fluidic channels, it is possible to nest these designs in concentric parallel fashion by disposing progressively larger pairs of outer sheath channels about the basic sheath/core/sheath mixer.

Figure 12B:
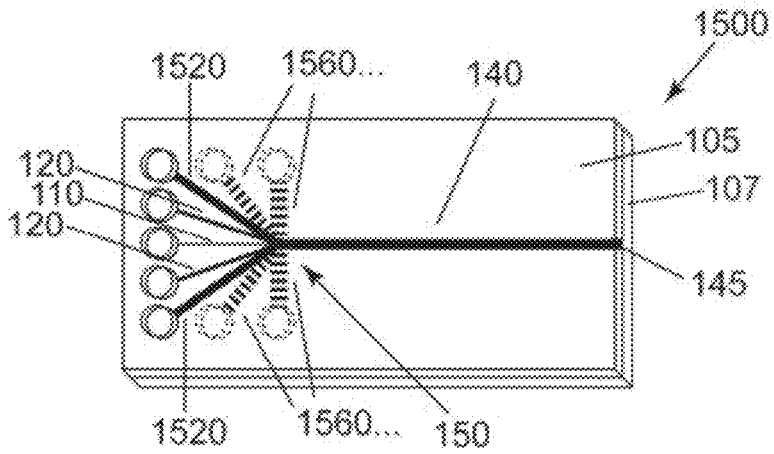
Figure 14A:
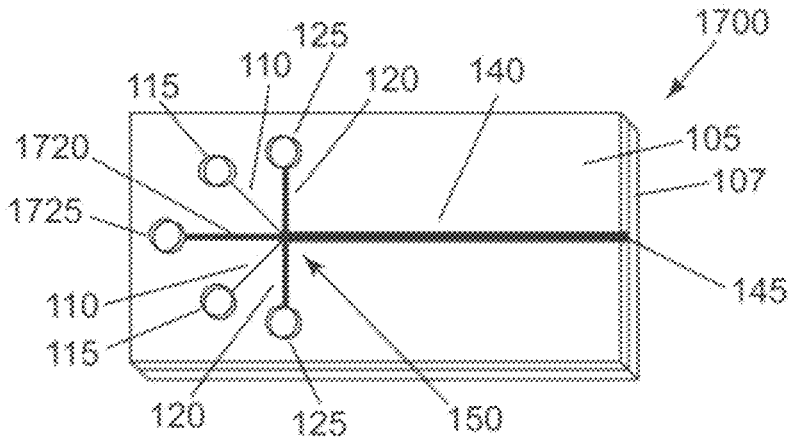
FIGS. 14A through 14C illustrate a simple parallel mixer in which two coaxial core/sheath flows share a common downstream channel.

FIG. 14A shows schematically a generalized on-chip microfluidic embodiment of a nested concentric coaxial mixer 1500. As in FIG. 1, microfluidic channels are fabricated within top substrate 105 and bottom substrate 107. FIG. 5A shows a simple five-channel nested parallel design in which core channel 110 receives fluid from core inlet 115 and delivers it to fluidic junction or mixer 150 where it merges with flow streams from symmetrically disposed sheath channels 120 and secondary or outer sheath channels 1520. The sheath channels receive their fluid from sheath inlets 125, while the secondary or outer sheath channels receive their fluid from outer sheath inlets 1525. Once combined in mixer 150, the five-stream flow assembly travels through downstream channel 140 to outlet 145. FIG. 12B shows an analogous nested parallel concentric coaxial mixer 1500 in which core channel 110 merges in mixer 150 with flow streams from a plurality of progressively larger pairs of concentrically disposed sheath channels 120, secondary sheath channels 1520, tertiary sheath channels 1560, and so forth.

Figure 12C:
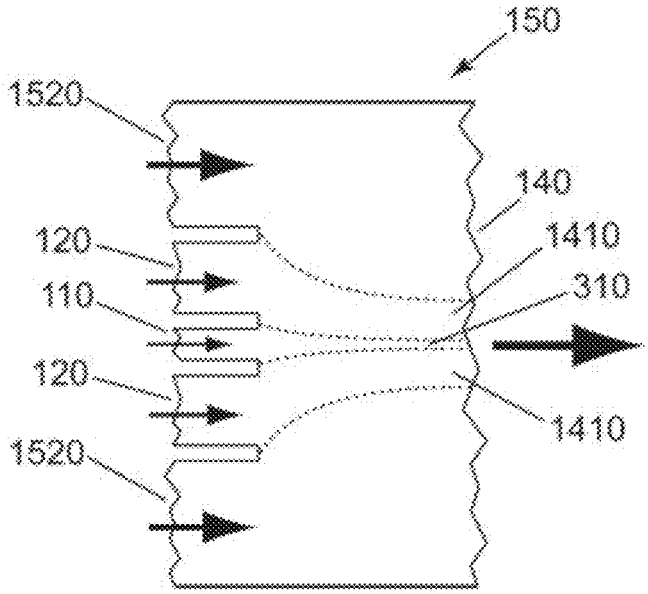

FIG. 12C illustrates schematically in two dimensions how flow focusing in the mixing junction 150 of a nested concentric coaxial mixer can produce multi-layered concentric coaxial flows with well-defined flow lamina geometries. Core flow enters mixer 150 through central core channel 110, while symmetrical sheath flows enter through sheath channels 120 and outer sheath flows enter through outer sheath channels 1520. Flow from the outer sheath channels 1520 focuses the inner sheath stream 1410 and also contributes, to the focusing of core stream 310 by flow from the inner sheath channels 120. The concentric assembly of core/inner-sheath/outer-sheath flows then proceeds into downstream channel 140. By altering the relative velocities of flow streams entering mixer 150 through said core, sheath, and outer sheath channels, the degree of focusing/defocusing, relative extent, and dimensions of core stream 310 and inner sheath stream 1410 can be effectively controlled.

FIG. 13 depicts two embodiments of a nested concentric coaxial half-mixer section 155. In this illustrative example, the basic coaxial mixing subunit and characteristic geometries are derived from the embodiment of the invention illustrated in FIG. 8A, but any of the embodiments represented in FIG. 4, 5, 6, 8, or 10 could serve as the basic subunit of the nested concentric coaxial mixer.

Figure 13A:
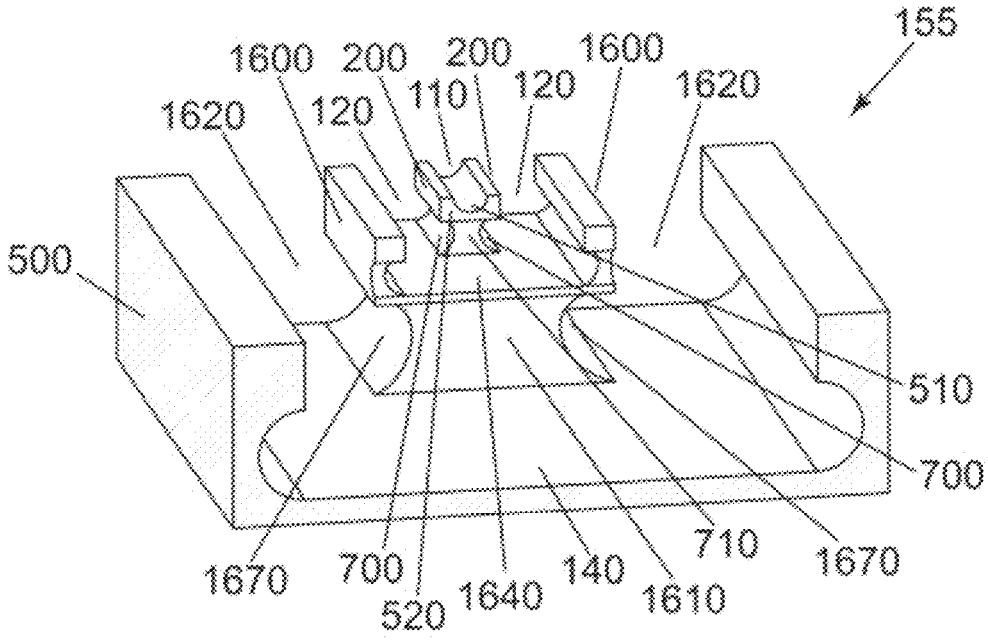
FIGS. 13A and 13B illustrate a nested parallel concentric core/sheath mixer fabricated using the approach of FIG. 8A.

FIG. 13A shows a half-mixer section 155 patterned on substrate 500. A central core channel 110 and neighboring sheath channels 120 flow into intermediate downstream channel 1640. As in FIG. 2A, the geometry of the core channel face 520 and flanking walls 200 are defined by the flanking wall undercuts 700, face undercut 710, and core orifice 510 features resulting from the fabrication process. The coaxial combination of flow streams resulting from the confluence of the core channel and sheath channels into the intermediate downstream channel effectively serves as the composite core flow with respect to a pair of secondary or outer sheath channels 1620 disposed symmetrically to either side of the inner sheath/core/sheath structure. Here, composite coaxial flow emerging from intermediate downstream channel 1640 and flow from the outer sheath channels 1620 merge into downstream channel 140, creating a three-layer coaxial flow. As depicted, the outer sheath channels may be fabricated by the same techniques that produced the undercut geometries in the disposition of core channel 110 and sheath channels 120. As such, outer flanking walls 1600 separating sheath channels 120 from outer sheath channels 1620 are similarly undercut by outer flanking wall undercuts 1670 and the outlet of intermediate downstream channel 1640 is undercut by outer face undercut 1610.

Figure 13B:
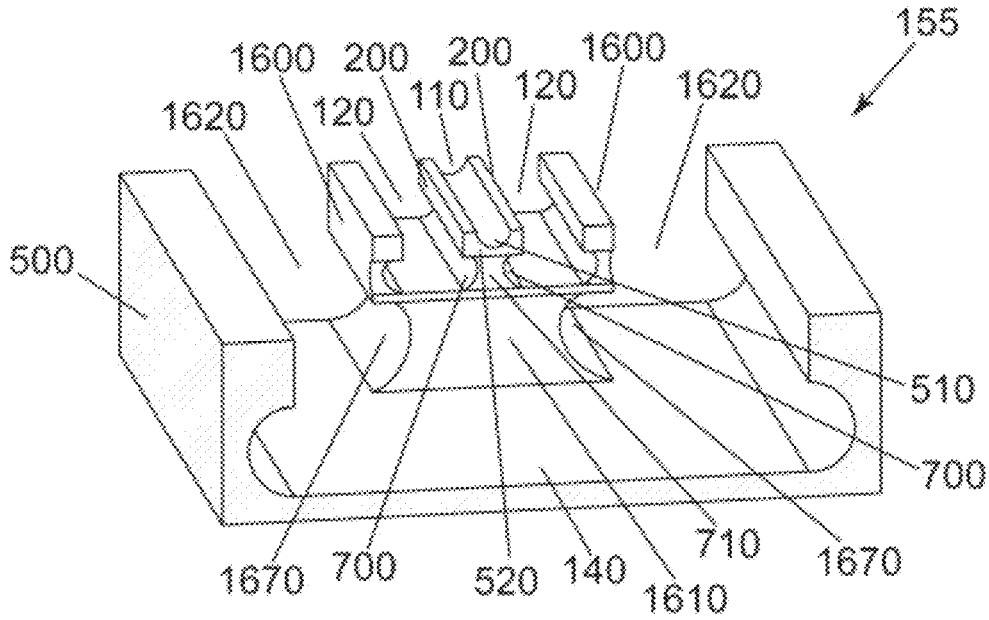

Another aspect of the invention is shown in FIG. 13B comprising a nested coaxial mixer in which core channel 110 and sheath channels 120 flow into downstream channel 140 at the same axial plane, without first merging into an intermediate downstream channel 1640 like that depicted in FIG. 13A. In this aspect of the invention, streams of the three different fluids from core channel 110, sheath channels 120, and outer sheath channels 1620 combine at the same axial position in truly parallel fashion.

Additional parallelization may be realized by fabricating successively deeper outer sheath channel pairs to either side of the nested inner structures, yielding a plurality of concentric coaxial layers limited primarily by the practicality and expense of the fabrication processes. Alternately, multiple nested coaxial mixers may be arranged serially in the manner of the embodiment of FIG. 11 to assemble a larger number of coaxial flow lamina without requiring an excessively costly fabrication process.

The geometry depicted for the embodiments of the invention illustrated in FIG. 13 may be produced by various means, but most directly lends itself to the same fabrication techniques applied to produce the embodiment of FIG. 8A: anisotropic etching followed by a side-wall protection step and subsequent undercutting of the anisotropically etched features by an isotropic etch. To create the embodiments of FIG. 13, this etch and undercut fabrication sequence would be repeated for each progressively deeper pair of outer sheath channels.

Embodiment

Common-Outlet Parallel Mixing—FIG. 14

FIG. 14 illustrates an alternative mixing embodiment which makes use of coaxial mixing subunits. A plurality of these subunits is arranged in parallel with the outflow of each subunit delivered into a common downstream channel. Unlike previous embodiments in which reactants diffuse radially between concentric core/sheath and core/sheath/outer-sheath flow lamina, in the embodiment of FIG. 14, reacting species diffuse laterally between neighboring core channel streams before interacting.

Figure 14B:
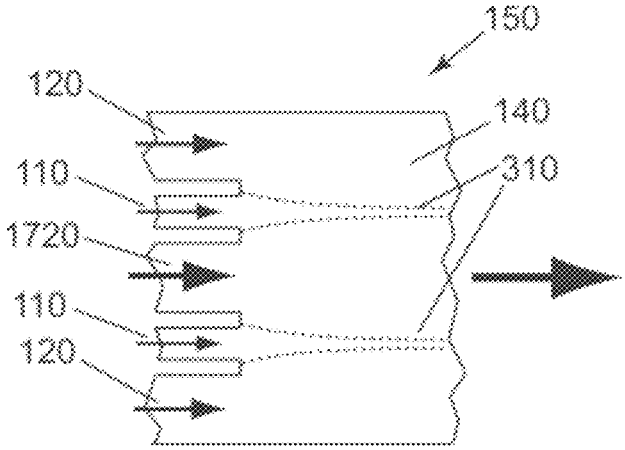

FIG. 14A shows schematically a generalized on-chip microfluidic embodiment of a common-outlet parallel mixer 1700. As in FIG. 1, microfluidic channels are fabricated within top substrate 105 and bottom substrate 107. FIG. 14A shows a simple five-channel parallel design in which two core channels 110 receive fluid from core inlets 115 and deliver it to fluidic junction or mixer 150 where it merges with flow streams from sheath channels 120 symmetrically disposed to either side of said core channels and shared sheath channel 1720 centrally located between said core channels. As depicted in FIG. 14B, the resulting five stream flow proceeds into common downstream channel 140 as an assembly of two parallel, individually coaxial core/sheath flows separated by the fluid from shared sheath channel 1720. As in previous examples, hydrodynamic focusing of the core flow streams 310 may be achieved by increasing said sheath and said shared sheath flow rates relative to the velocity of said core channel flow streams.

Figure 14C:
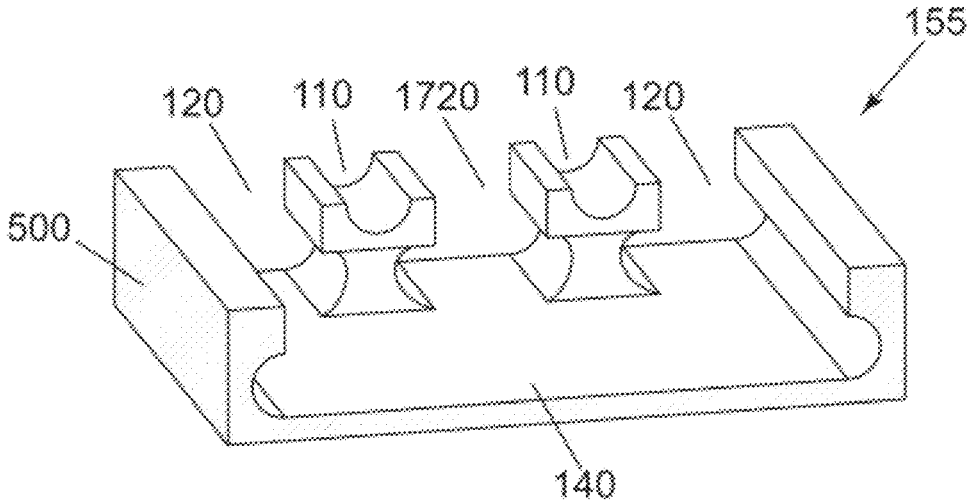

FIG. 14C shows a common-outlet parallel half-mixer section 155 fabricated with two coaxial mixing subunits and characteristic geometries derived from the embodiment of FIG. 8A. In operation, neighboring parallel core flow streams 310 of different reactants diffuse laterally through the intervening nonreactive fluid emerging from shared sheath channel 1720 before reacting. Core flow streams 310 are readily focused as in previous embodiments by adjusting the relative flow rates of fluid in core channels 110, sheath channels 120 and shared sheath channel 1720. The novel diffusive mixing geometry resulting from the migration of reactants between neighboring core flows may prove advantageous in some microreactor applications.

Representative Design and Operating Parameters

The following specifications provide information about typical and currently preferred geometry, scale, configuration, and operating regimes of the various embodiments described above, and are to be construed as instructive rather than comprehensive, optimal, or restrictive. In general, on-chip mixer embodiments described herein operate with flow rates in the laminar regime corresponding to Reynolds numbers substantially in the range 0.001 to 100. Substantially above this range, vorticity and mixing due to flow recirculation begin to compromise the uniformity of the reacting interface in the mixers. As noted above, smoothing the geometry of core and sheath confluence and minimizing the area of core face 510 where practical can delay the onset of vorticity until higher Reynolds numbers are reached.

Typical feature dimensions of the embodiments of the invention described herein are constrained primarily by fabrication process limitations. General-purpose lithographic processes yield minimum feature sizes substantially on the order of 1 micron. Anisotropic plasma etching processes (e.g., deep reactive ion etching of silicon) can readily create features hundreds of microns deep, while etching structures substantially deeper than a few tens of microns with wet isotropic etching (e.g., etching quartz with hydrofluoric acid) can prove challenging. Accordingly, a typical example of the embodiment of FIG. 8A might have core channel 110 diameter of 20 microns, sheath channels 120 with typical width and depth of 70 microns, flanking walls 200 of 20 micron width, and flanking wall undercuts 700 and face undercut 710 of 20 microns radius. For such a mixer geometry, a typical operating regime for three-dimensional hydrodynamic focusing might include a core flow rate of 1 μL/min and combined sheath flow rates of 150 μL/min, yielding a roughly 8:1 sheath:core velocity ratio. In general design terms, for a given implementation of a particular mixer embodiment, sheath channels 120 are currently preferred to be substantially at least twice as deep in the direction normal to the substrate surface as core channel 110. For embodiments with undercut features that enable true three-dimensional core/sheath focusing the relative degree of lateral and vertical focusing depends on sheath channel 120, flanking wall undercut 700, and face undercut 710 geometries. Deeper, narrower sheath channels tend to enhance vertical focusing, while wider, shallower sheath channels yield greater lateral focusing. Similarly, larger flanking wall undercuts 700 and/or face undercuts 710 enhance vertical focusing. In general, the greater the extent of flanking wall and face undercuts, the more closely the on-chip mixer will approximate nearly ideal coaxial flow and 3D hydrodynamic focusing. The depth and/or lateral extent of each flanking wall undercut 700 is currently preferred to be substantially one-quarter or more of the maximum width of core channel face 510.

Modeling suggests that geometries substantially minimizing the angle of the core/sheath channel intersection like those depicted in FIGS. 2C and 2D are generally preferred to geometries with larger angle intersections like those depicted in FIGS. 2A and 2B. As noted above, it is also preferable to minimize the area of core channel face 520 by tapering lateral flanking walls 200 and/or increasing the extent of face undercut 510. In general, provided that it is substantially symmetrical, the particular geometry of core orifice 510 (e.g., circular, oblong, rectangular, etc.) in any of the embodiments considered has only an incidental effect on final core/sheath interface geometry and flow focusing. As such, orifice geometries depicted for each embodiment of the invention should not be construed as restrictive.

Method of Operation

Preventing Clogging at Shutdown—FIG. 15

One limitation to the practicality of micro fluidic particle generating reactors is imposed by transient operational states occurring at start-up and especially shutdown. When the reacting flow through the system stagnates (as at shutdown), crystal precipitation is no longer confined to an isolated interface in the middle of the flow stream; and crystals will accordingly nucleate and grow in uncontrolled ways on the internal surfaces of the system. Fouling of the channels with particles under these conditions can potentially result in clogging or other undesirable conditions when operation is later resumed. Relative to large-scale reactors, this problem is particularly pronounced in micro scale systems where the surface-to-volume ratio inside the device is much higher.

The most obvious way to avoid crystallization at shutdown is to immediately flush reacting species from the system with an inert liquid (e.g., water) to dilute and sweep out any residual reactants. Complicating this approach is the desirability of transitioning as smoothly as possible from delivery of reactants to delivery of flushing liquid to minimize perturbation of the reacting interface and avoid flow stagnation. By maintaining uninterrupted flow during this transition, the last of the reacting species (and resulting particles) to traverse the system as flushing begins would substantially experience the same reaction history and residence time as the crystals produced during steady-state operation, minimizing particle variability due to the end-of-run flush.

In practice, seamless flow switching between reacting and flushing liquid streams proves very challenging to achieve. Even a fast acting selector valve produces some brief stagnation as it transitions between reacting and flushing fluid lines, and attempts to either synchronize pumps to that transition or pre-pressurize the flushing line ahead of the transition also result in flow disturbances. Delivering reactant and flushing liquids into a common line (e.g., through a tee) and ramping down reactant flow as flushing flow is ramped up to maintain constant flow rate is another option. In this case, however, the average concentration of reactant in the channel will decline gradually during the transition, and its spatial distribution relative to the flushing liquid may be nonuniform, yielding non-ideal reaction conditions when that volume or bolus of reactant reaches the reactor/mixer. Dual-valve arrangements in which flushing flow is initiated and the flushing valve is opened before the reacting flow is stopped and the reacting valve closed also suffer from finite valving transients and the possibility of "overlapping" reactant and flushing flows. Again, if no steps are taken to segregate particles resulting from these transient periods from the rest of the steady-state product, average particle quality and size distribution of the batch will suffer.

To address these complications, we have conceived and reduced to practice a fluid-queuing technique in which sequential batches of liquid are loaded into a holding volume (typically a high-aspect ratio length/width channel, capillary, or length of tubing) prior to the start of the particle production run. When the run is started, the contents of each holding volume (one for each reactant flow entering the mixer) are delivered in continuous fashion through the microreactor system. In this way, a bolus of reactant can be followed immediately (with or without a separating bubble or intervening immiscible liquid droplet) by an inert flushing liquid such as water or some other solvent. Virtually any sequence of compatible neighboring fluids can be delivered in this manner, and the degree of mixing at the interface between each bolus, depending on fluid velocity and channel geometry, can be readily predicted using Taylor dispersion calculations familiar in the art. In the preferred embodiment of this method, no bubbles or immiscible liquid separators are required between fluid boluses, as this approach will produce the most uniform reaction and flow conditions during the course of the particle production run.

FIGS. 15A through 15D provide a generalized, functional schematic illustration of the currently preferred embodiment of this method of operation. A queued injection reagent delivery subsystem 1800 enables delivery of one reactive fluid component through a tube, capillary, or outlet channel 1870 to a downstream microreactor or mixer such as those described above. In the context of the overall fluidic architecture presented in FIG. 1 outlet channel 1870 would be fluidly coupled to either core inlet 115 or sheath inlets 125, for example. In some implementations, some or all of the elements composing queued-injection subsystem 1800 could be fabricated on-chip.

Referring again to FIGS. 15A through 15D, the queued-injection subsystem 1800 comprises a collection of elements interconnected by fluidic channels, capillary, or tubing. A flushing fluid reservoir 1810 is connected to a flushing valve 1830: Flushing valve 1830, depicted as a three-way valve, provides fluid communication between a positive displacement pump 1820, depicted as a syringe pump, and either flushing fluid reservoir 1830 or a holding volume 1840. Holding volume 1840, depicted as a coil of tubing or capillary, is a fully-swept fluid channel with an axial length substantially greater than its width and a total volume larger than the volume of reacting fluid to be delivered to the downstream microreactor/mixer in any one microreactor run. A reagent valve 1850, depicted as a three-way valve, provides fluid communication between holding volume 1840 and either outlet channel 1870 or reagent reservoir 1860.

Figure 15A:
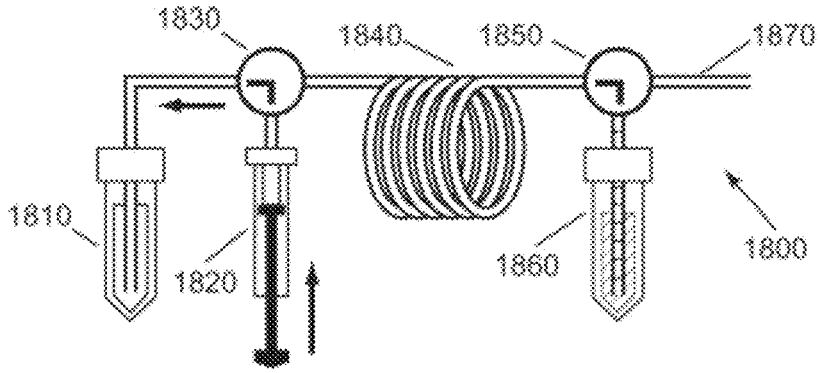
FIGS. 15A through 15D illustrate a generalized queued-injection reagent delivery method enabling particle-generating microreactor operation without clogging at shutdown.

The operation of queued-injection reagent delivery subsystem 1800 is illustrated sequentially in FIGS. 15A through 15D. Referring now to FIG. 15A, holding volume 1840 and fluid interconnects of queued injection subsystem 1800 are initially primed with non-reactive flushing liquid (e.g., water). Flushing valve 1830 is activated to make a fluidic connection between flushing fluid reservoir 1810 and positive displacement pump 1820. Pump 1820 is then activated to deliver into flushing fluid reservoir 1810 a volume of flushing fluid equal to the volume of reagent which is to be delivered to the downstream microreactor/mixer.

Figure 15B:
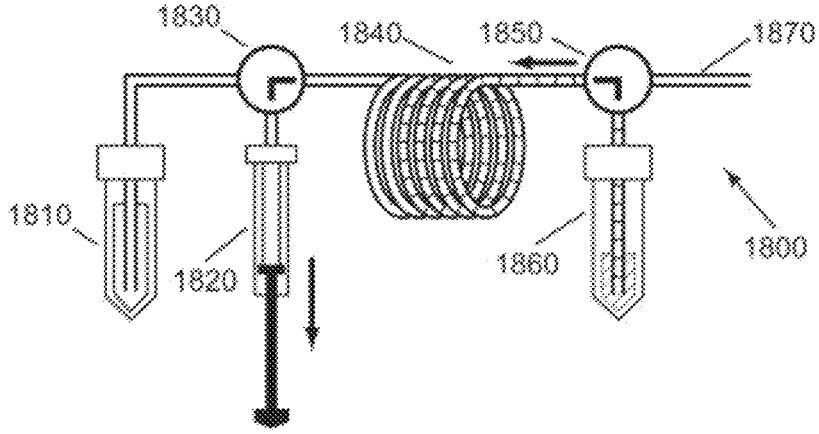

Referring now to FIG. 15B, flushing valve 1830 is activated to make a fluidic connection between pump 1820 and holding volume 1840, while reagent valve 1850 is activated to make a fluid connection between holding volume 1840 and reagent reservoir 1860. Pump 1820 is then activated to pull flushing liquid from holding volume 1840 and draw a corresponding volume of reagent liquid from reagent reservoir 1860 into the holding volume. The downstream portion of holding volume 1840 is now filled with a bolus of reagent fluid immediately adjacent to a bolus of flushing fluid in the upstream portion of said holding volume.

Figure 15C:
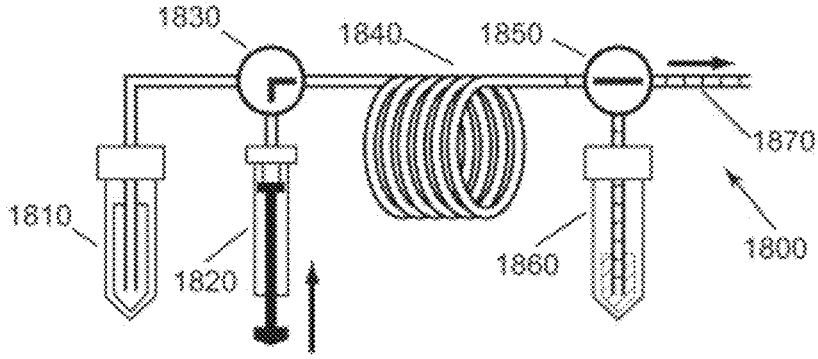

Referring now to FIG. 15C, reagent valve 1850 is activated to make a fluidic connection between holding volume 1840 and outlet channel 1870. Pump 1820 is then actuated to push the boluses of reagent and flushing liquid in continuous serial fashion out of holding loop 1840, past reagent valve 1850 and through outlet channel 1870 into the microreactor/mixer downstream. Pump 1820 continues to push the serial arrangement of reagent and flushing fluid boluses through the downstream micro reactor system until no reacting species remain in the microreactor and sufficient flushing fluid has passed to adequately dilute or rinse away any residual reactants.

Figure 15D:
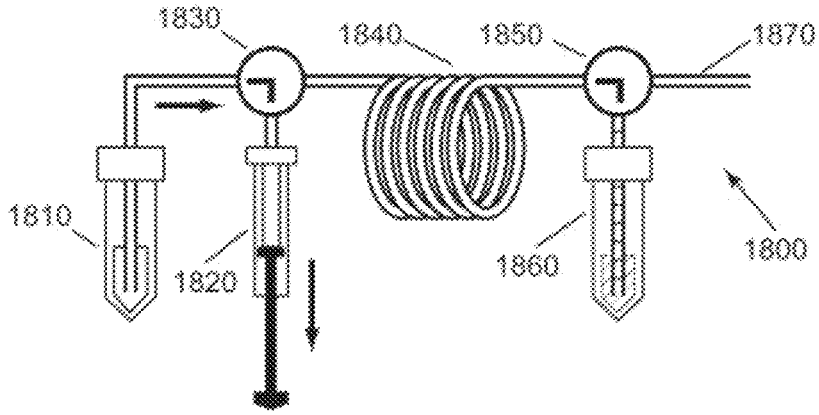

Referring now to FIG. 15D, flushing valve 1830 is activated to make a fluid connection between flushing fluid reservoir 1810 and pump 1820 and activating reagent valve 1850 to make a fluidic connection between holding loop 1840 and reagent reservoir 1860. Pump 1820 is then activated to draw in a volume of flushing fluid corresponding to the sum of both flushing and reagent fluids delivered to the microreactor system, restoring the initial configuration of queued-injection subsystem 1800 prior to the actuation depicted in FIG. 15A. If another microreactor run is to be conducted immediately, pump 1820 need only draw in a volume of flushing fluid equal to the volume of flushing fluid delivered to the micro reactor (i.e., not including the reagent delivery volume) before proceeding to the step depicted in FIG. 15B.

While depicted in largely conceptual, schematic terms, the components of queued-injection subsystem 1800 could be implemented in a variety of ways providing that the basic operation of the continuous queued-injection approach is retained. Fluid aspiration and injection functionality attributed to pump 1820 could be furnished by any suitable positive displacement pump coupled serially to a fluidic accumulation reservoir, or by other pumps operated in closed-loop fashion with flow and/or pressure sensors. Suitable fluid delivery means include any pumps capable of generating adequate suction and injection pressures and include syringe or metering pumps, peristaltic pumps, electroosmotic pumps, diaphragm pumps, and the like. Eliminating the need for a separate fluid delivery pump, flushing and reagent fluids could be delivered directly from their respective reservoirs by pressurizing the reservoir head-space. Valve functionality like that described for flushing valve 1830 and reagent valve 1850 could be furnished by manual or automated fluid routing means including three-way valves as described or combinations of two-way valves, check valves, pinch valves, and the like, any of which may be implemented at tubing scale, capillary scale, or on-chip. Fluid storage functionality furnished by flushing fluid reservoir 1810 and reagent reservoir 1860 could be provided by various fluid containment means including vials, bottles, bags, bladders, test- or centrifuge tubes, lengths of tubing or capillary, on-chip channels or chambers, manifolds, elastic envelopes, free-piston syringes, and the like. As noted, fluid containment and delivery functionalities may be combined in some implementations, as in the case of a reservoir with pressurized headspace. Fluid staging functionality like that provided by holding volume 1840 can be provided by any serial queuing means including a fully-swept tube, capillary, or channel of adequate total volume and substantially large length-to-width ratio. Materials should be selected for the serial queuing means such that its inner surfaces are readily rinsed by the flushing fluid of choice, and do not substantially retain reactant species or other impurities which could affect the consistency of microreactor operation.

Conclusions, Ramifications, and Scope

Discussion of the various embodiments of the invention has focused largely on conventional micromachining substrates, techniques, and materials (e.g. silicon, silicon-on-insulator, glass, quartz, fused-silica, etc.). More generally, however, the embodiments of the present invention may be realized using a variety of inorganic or organic materials, including ceramics, insulators, metals, polymers (e.g. cycloolefins, acrylic and poly-methyl methacrylates, fluoropolymers, polyoxymethylenes, polyimides, polyxylylenes, and the like) photo-patternable materials and epoxies (e.g. photoresists, SU-8 resist, spin-on and photo-patternable glasses, and the like), semiconductors, biomaterials, and the like.

As noted, the mixing devices disclosed herein can be readily fabricated in transparent materials like quartz, fused silica, polymers, and the like which are amenable to various optical and spectroscopic particle or fluid diagnostic techniques including elastic, inelastic, quasi-elastic, or dynamic light scattering; multi-angle laser light scattering; microscopic image or video analysis; fluorescence microscopy; hyperspectral imaging; ultraviolet-, visible-, or laser-induced fluorescence; optical absorbance, transmittance, or reflectance; refractive index measurement; absorption, emission, fluorescence, ultraviolet/visible, x-ray, gamma-ray, infrared, near-infrared, Fourier transform infrared, plasma-emission, Raman, coherent anti-Stokes Raman, surface enhanced Raman, resonance Raman, or photoemission spectroscopy techniques; nuclear-magnetic-resonance spectroscopy; or the like. These techniques offer the potential for real-time in-situ characterization, analysis, and quality control of particle generation or reaction processes. Additional diagnostic functionalities applicable to the mixing devices of the present invention could include measurements of electrical impedance, voltage, electrochemical potential, electromagnetic permittivity, dielectric constant, electromagnetic permeability, electrical conductivity, electrical resistance, inductance, capacitance, electric field strength, or magnetic field strength, temperature, thermal conductivity, thermal resistance, heat flux, heat capacity, latent heat, heat of reaction, chemical concentration, particle inertia or mass properties, density, specific gravity, viscosity, particle sedimentation rates, acoustic impedance, or the like.

Additional on-chip elements may be advantageously integrated with the coaxial mixing embodiments described herein, including but not limited to heating and cooling elements, electrodes, optical components, insulative-dielectrophoresis arrays, sampling channels, inertial particle separation structures, dialysis and ion exchange membranes, filters, packed beds, gels, catalytic structures and surfaces, magnets and inductive elements, capacitive sensors, pressure sensors, and the like. Such elements may be integrated into the coaxial mixers themselves or into upstream, intermediate, or downstream stages to provide added control over particle production, reaction, or sample handling processes. Moreover, microreactor elements can be integrated with various means of fluid control, routing, handling, and disposition including pumps, valves, manifolds, mixers, vanes, pillar arrays, junctions, constrictions, dilations, nozzles, diffusers, wicking structures, capillaries, reservoirs, and the like, including arbitrary microchannel configurations substantially different from and more complex than those suggested by the basic representative examples of FIG. 1, 11A, 12A, or 14A.

Particulate materials which may be readily and/or advantageously produced using the coaxial diffusional mixing microreactor architectures described herein include but are not limited to insoluble or sparingly soluble organic and inorganic salts, other inorganic compounds, metals, ceramics, polymers, semiconductors, catalyst materials, thermoelectric materials, metal-organic frameworks, nanoparticles, quantum dots, organometallic compounds, hydrogen storage materials, organic compounds, biological materials, energetic materials, explosives, fuels, oxidizers, and the like. Particle production from fluid solutions or mixtures due to changes in reaction parameters including but are not limited to physical state, temperature, concentration, activity, solubility, oxidation state, ionization, pH, and the like imposed on chip or by the coaxial mixers themselves is also possible. Coaxial reactors may be adapted for homogeneously catalyzed reactions or catalytic reactions occurring on particles or the interior surfaces of the system.

While primarily targeted at the production of particles to some final size specification (nanometers to tens or hundreds of microns), the systems described here can also be used to generate highly uniform seed crystals for growth to a final desired size by subsequent processes on or off chip, including traditional large-scale continuous or batch processes. Production of larger particles can also be achieved by increasing the fluidic channel size of the microreactor and adjusting the flow rates of reactants to maintain laminar flow conditions. The microreactor and fluidic channels may also be oriented with respect to gravity (e.g. vertically) to avoid difficulties associated with particle settling or buoyancy as particle size increases.

The coaxial reactor designs described herein also provide favorable means for producing various multi-phase coaxial flows, either in the form of continuous streams of different fluid phases or streams of serially produced discrete fluidic volumes. These multiphase streams can take the form of immiscible liquid droplets produced by the core flow channel in a liquid sheath flow, liquid aerosol droplets in a gaseous sheath flow, gas bubbles in a liquid sheath flow, or liquid-encapsulated gas bubbles in a gaseous sheath flow, and the like. The coaxial mixer geometry can also enable the serial production of lamellar structures based on amphiphilic or hydrophobic/hydrophilic molecules such as micelles, reverse micelles, liposomes, multi-wall vesicles, and the like. Multiphase streams can be generated either by pulsing or otherwise relatively modulating the core and sheath flows, by forming thin elongated streams which collapse into individual droplets due to surface tension effects (Rayleigh instability) or vortex shear, by using actively controlled means such as local heating/cooling, electrowetting, intermittent laser illumination, electromagnetic fields, and the like, or by local surface treatment of the core flow orifice, core channel face, flanking walls, or sheath channels to yield a flow resistance which will be overcome periodically by accumulated upstream channel pressure (e.g. a hydrophobic zone past which an aqueous droplet will move only when the pressure exceeds some threshold, etc.), and the like.

Beyond particle and droplet production, the coaxial mixing architecture presented herein can also be applied to the manufacture of elongated threads or rods of well-defined geometry produced by continuous crystallization, polymerization, or multi-stage precipitation-aggregation processes in the reacting stream. Coaxial reaction schemes may also offer benefits to non-precipitation or non-particle producing reactions, gas generating reactions, reacting gas-gas laminar flows, reacting plasmas, or purely liquid-liquid reactions due to the symmetry and uniformity of the reacting interface and the independence of free-stream reactions from wall interactions and surface chemistry. As such, these structures can further be adapted for use in combustion or thrust-production applications, combining streams of fuel and oxidizer or other energetically-reacting species.

The ability of the coaxial flow mixer described here to produce three-dimensional hydrodynamically focused flow in a chip-based format also offers advantages for non-reacting flow systems in which it is desirable for one flow component and its constituents to be introduced into another in a very well-defined and spatially constrained manner. Such applications include flow cytometry and related techniques for cell and particle counting, detection, analysis, manipulation, measurement, sorting, or separation. Sample particles entrained/suspended in the fluid are introduced through the core channel, focused by the core/sheath mixer into a very thin, centrally positioned stream, and interrogated as they pass in single-file serial fashion through the focus of a laser spot or other detection, analysis, or sorting means.

While smooth, steady, laminar flow is assumed as the preferred operating regime for producing particles with the coaxial flow designs presented herein, benefits may be realized in some applications for operating such a system at higher Reynolds numbers, particularly in regimes where stable laminar vortices or recirculations can be established. These conditions offer the ability to furnish enhanced advective mixing which offers benefits for system flushing/cleaning and applications where rapid mixing is preferable to slower but more uniform diffusive mixing. The ability to transition readily from recirculating to non-recirculating flow by simply adjusting microreactor flow rates or channel geometries potentially enables novel modes of operation and offers an opportunity to measurably distinguish or partition different segments of a continuous flow or to modulate mixing conditions to smooth/delineate the transition between operating states.

We claim:

1. A fluid flow mixer comprising;

first and second structure halves joined at a common surface to form a substantially enclosed network of fluid channels, wherein the first half is a mirror image of the second half, and wherein each of the structure halves comprise a channel network formed into the respective common surface of each half in mirror image relationship, each of the structure halves further comprising:

a core flow channel having an inlet and an outlet having a predefined cross-section;

first and second sheath flow channels each having first ends, respectively defining inlets and second ends, respectively defining outlets having equivalent and predefined cross-sections substantially larger than the predefined cross-section of the core flow channel outlet, and wherein the first and second sheath flow channels are each disposed symmetrically on opposite sides of the core flow channel and separated from the core flow channel by first and second flanking walls, wherein the core flow channel and the first and second sheath flow channel each respectively direct a flow of fluid;

a fluidic junction defined by a region comprising the intersection of the outlets of the first and second sheath flow channels and the outlet of the core flow channel; and an outlet channel or channels intersecting the fluidic junction into which fluid from the core flow channel and from the first and second sheath flow channels proceed after merging in the fluidic junction.

2. The fluid mixer of claim 1, wherein the flanking walls on either side of the first and second sheath flow channels are undercut in a lateral direction by the first and second sheath flow channel, thereby providing for fluid exiting the first and second sheath flow channel to flow past the core flow channel before entering the fluidic junction.

3. The fluid mixer of claim 2, wherein the sheath channels are angled or the flanking walls tapered to form a minimal core face area at the core flow channel outlet.

4. The fluid mixer of claim 2, wherein the undercut of the flanking walls is at least one-quarter of the maximum width of the core channel face.

5. The fluid mixer of claim 1, wherein the fluid is a liquid.

6. The fluid mixer of claim 1, wherein the fluid flow rates correspond to Reynolds numbers of greater than 0.001 to about 1000.

7. The fluid mixer of claim 1, wherein the substrate is silicon, semiconductor, quartz, fused silica, glass, ceramic materials, polymers, metals or a composite thereof.

8. The fluid mixer of claim 1, further including means for particle or fluid diagnostics.

9. The fluid mixer of claim 8, wherein particle or fluid diagnostic means include elastic, inelastic, quasi-elastic, or dynamic light scattering; multi-angle laser light scattering; microscopic imaging or video imaging analysis; fluorescence microscopy imaging; hyper-spectral imaging; ultra-violet-, visible-, or laser-induced fluorescence; optical absorbance, transmittance, or reflectance; refractive index measurement; absorbance, emission, fluorescence, ultraviolet, visible, x-ray, gamma-ray, infrared, near-infrared, plasma emission, Raman, coherent anti-Stokes Raman, surface enhanced Raman, resonance Raman, photoemission, or nuclear-magnetic resonance spectroscopy.

10. The fluid flow mixer of claim 8, wherein particle or fluid diagnostic means include measurement of temperature, thermal conductivity, thermal resistance, heat flux, heat capacity, latent heat, heat of reaction, chemical concentration; measurement of inertial or mass properties, density, specific gravity, or viscosity; particle image velocimetry, particle sedimentation, flow separation, or velocity-gradient-induced migration, acoustic impedance; measurement of electrical impedance, voltage, electrochemical potential, electromagnetic permittivity, dielectric constant, electromagnetic permeability, electrical conductivity, electrical resistance, inductance, capacitance, electric field strength, or magnetic field strength.

11. A method for particle synthesis, comprising the steps of:

providing the fluid mixer of claim 1;

providing at least two liquid reagents, wherein the interaction of the reagents causes a precipitation of one or more solid products;

flowing the first reagent in the core channel; and flowing the second reagent in the sheath channels.

12. A method for controlling particle synthesis, comprising the steps of:

providing the fluid mixer of claim 1;

providing at least two liquid reactants;

flowing one of the reactants in the core channel;

flowing the second reactant in the sheath channels; and controlling the lateral extent of the reaction interface by hydrodynamically focusing the core flow.

13. The method of claim 12 wherein the ratio of sheath fluid flow rate to core fluid flow is about 1:10 to 100:1.

14. A serial fluid mixer, comprising:

a first fluid mixer as in claim 1, in serial fluid communication with a second fluid mixer substantially equivalent to the first fluid mixer, wherein the fluid outflow from the first fluid mixer provides the input core flow into the second fluid mixer.

15. The serial fluid mixer of claim 14, further including a plurality of additional fluid flow mixers as in claim 1 arranged in serial sequence wherein the outlet flow of each fluid flow mixer provides the input flow into the core flow channel of each subsequent fluid flow mixer.

16. The fluid mixer of claim 14, further including means for particle or fluid diagnostics.

17. The fluid mixer of claim 16, wherein particle or fluid diagnostic means include elastic, inelastic, quasi-elastic, or dynamic light scattering; multi-angle laser light scattering;

microscopic imaging or video imaging analysis; fluorescence microscopy imaging; hyper-spectral imaging; ultra-violet-, visible-, or laser-induced fluorescence; optical absorbance, transmittance, or reflectance; refractive index measurement; absorbance, emission, fluorescence, ultraviolet, visible, x-ray, gamma-ray, infrared, near-infrared, plasma emission, Raman, coherent anti-Stokes Raman, surface enhanced Raman, resonance Raman, photoemission, or nuclear-magnetic resonance spectroscopy.

18. The fluid flow mixer of claim 16, wherein particle or fluid diagnostic means include measurement of temperature, thermal conductivity, thermal resistance, heat flux, heat capacity, latent heat, heat of reaction, chemical concentration; measurement of inertial or mass properties, density, specific gravity, or viscosity; particle image velocimetry, particle sedimentation, flow separation, or velocity-gradient-induced migration, acoustic impedance; measurement of electrical impedance, voltage, electrochemical potential, electromagnetic permittivity, dielectric constant, electromagnetic permeability, electrical conductivity, electrical resistance, inductance, capacitance, electric field strength, or magnetic field strength.

19. A method for moderating one or more physical and/or chemical processes, comprising:

providing said serial fluid mixer of claim 14;

injecting a first reactant fluid into the core channel of the first fluid mixer; injecting a non-reactive fluid into the sheath channels of the first fluid mixer;

flowing the combination of the reactant and non-reactive fluids into the core channel of the second fluid mixer;

injecting a second reactant fluid into the sheath channels of the second fluid mixer of said serial fluid mixer; and controlling the rate at which the first and second reactant fluids interact by controlling the lateral extant of the non-reactive fluid through hydrodynamic focusing by adjusting the flow rates in the first core flow channel, and the first and second sheath flow channels.

20. A method for producing heterogeneous composite particles, comprising: providing the serial fluid mixer of claim 14;

injecting a reactant fluid into the core channel of the first fluid mixer;

injecting a reacting fluid into the sheath channels of the first fluid mixer, thereby precipitating seed crystals within the fluid stream;

flowing the combination of fluid and seed crystals into the core channel of the second fluid mixer; and injecting a second reacting fluid into the sheath channels of the second fluid mixer of said serial fluid mixer.

21. A method for moderating multi-stage chemical reaction and precipitation processes or producing heterogeneous composite particles, comprising:

providing the serial microreactor of claim 15;

injecting a plurality of reactant or non-reactive fluids into the core channel inlet and sheath channel inlets of said microreactor;

controlling the rate at which the plurality of concentric reactant and non-reacting fluid lamina interact through hydrodynamic focusing by adjusting the ratio of core channel flow rate to the plurality of sheath channel flow rates and the ratios of sheath channel flow rates to other sheath channel flow rates.

* * * * *